US008270660B2

(12) United States Patent
Endo

(10) Patent No.: US 8,270,660 B2
(45) Date of Patent: Sep. 18, 2012

(54) SPEAKER DEVICE AND SPEAKER UNIT

(75) Inventor: Nobuhiro Endo, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 859 days.

(21) Appl. No.: 12/306,059

(22) PCT Filed: Jul. 3, 2006

(86) PCT No.: PCT/JP2006/313235

§ 371 (c)(1),
(2), (4) Date: Dec. 22, 2008

(87) PCT Pub. No.: WO2008/004272

PCT Pub. Date: Jan. 10, 2008

(65) Prior Publication Data

US 2009/0180648 A1 Jul. 16, 2009

(51) Int. Cl.
*H04R 1/02* (2006.01)

(52) U.S. Cl. ..... 381/395; 381/386; 381/412

(58) Field of Classification Search ..... 381/184, 381/335, 336, 374, 385, 386, 395, 412, 415
See application file for complete search history.

(56) References Cited

U.S. PATENT DOCUMENTS 4,152,552 A * 5/1979 Meyer ..... 381/340
5,022,488 A * 6/1991 House ..... 181/156
(Continued)

FOREIGN PATENT DOCUMENTS

JP 63-44595 3/1988
(Continued)

OTHER PUBLICATIONS

English machine translation of JP05-316592.*

*Primary Examiner* — Tom Thomas
*Assistant Examiner* — Christopher M Roland
(74) *Attorney, Agent, or Firm* — Arent Fox LLP

(57) ABSTRACT

A simple structure will achieve dissipation of heat from the area inside a voice-coil bobbin and a diaphragm without a reduction in sound quality, in which a process for assembling a speaker device with high accuracy is performed in a simple operation. A speaker device comprises a recess-shaped frame 5 which supports, through an edge 9, a vibration system member 68 provided with a diaphragm 8 coupled to a voice-coil bobbin 6, and a magnetic circuit 4 which comprises an approximately ring-shaped magnet 2 and an approximately ring-shaped plate 3 which are mounted on a yoke 1 disposed in the frame 5, and a magnet gap 4*g* in which a voice coil 7 wound on a voice-coil bobbin 6 is disposed. In the magnetic circuit 4 a through hole 45 extending in the vibration direction of the diaphragm is fitted over a center boss 51 of a shape protruding from the bottom of the frame 5 in the direction of the sound emission, so that the magnetic circuit 4 is positioned and fixed with respect to the frame 5. An air passage 85 is formed along the center boss 51 fitted into the through hole 45 of the magnetic circuit 4 to establish communication between the inside of the voice-coil bobbin 6 and the outside of the frame.

23 Claims, 18 Drawing Sheets

U.S. PATENT DOCUMENTS

| | | | | |
|---|---|---|---|---|
| 5,042,072 | A * | 8/1991 | Button | 381/397 |
| 5,357,586 | A * | 10/1994 | Nordschow et al. | 381/397 |
| 7,831,059 | B1 * | 11/2010 | Sahyoun | 381/397 |
| 2003/0081808 | A1 * | 5/2003 | Kemmerer | 381/412 |
| 2003/0215109 | A1 * | 11/2003 | Kosuda | 381/412 |
| 2004/0042631 | A1 * | 3/2004 | Amino | 381/412 |
| 2004/0066263 | A1 * | 4/2004 | Zhang | 336/178 |
| 2005/0226458 | A1 * | 10/2005 | Sugiura | 381/412 |
| 2011/0135111 | A1 * | 6/2011 | Suzuki | 381/86 |

FOREIGN PATENT DOCUMENTS

| | | | |
|---|---|---|---|
| JP | 05316592 | A * | 11/1993 |
| JP | 2002-247687 | A | 8/2002 |
| JP | 2002-271889 | A | 9/2002 |

* cited by examiner

SPEAKER DEVICE AND SPEAKER UNIT

TECHNICAL FIELD

This invention relates to a speaker device and a speaker unit.

BACKGROUND ART

A typical speaker, for example, comprising a dome diaphragm has a voice coil wound on a voice coil bobbin connected to the diaphragm. The voice coil is disposed in a magnetic gap of a magnetic circuit so as to vibrate therein, and the diaphragm is fixed to a speaker frame through an edge. In the speaker structured as described above, upon receipt of an electric signal at the voice coil from the outside, the electromagnetic action produces a drive force on the voice coil, so that the diaphragm vibrates to emit a sound wave.

In the speaker with the above structure, the space inside the voice coil and the diaphragm is substantially hermetically sealed. Because of this, disadvantageous problems may arise: during the operation of the speaker, the vibration of the diaphragm causes an air temperature in the sealed space to become relatively high; the heat generated on the voice coil cannot be easily dissipated; the air temperature in the sealed space, for example in a vehicle-mounted speaker, rises to become relatively high when the temperature in the car's interior is relatively high at midsummer or the like; the above-described heat or back pressure causes deformation of the diaphragm; the deformation of the diaphragm reduces the sound quality of the reproduced sound; and the like.

A cone speaker device disclosed in Patent Document 1 has a cap provided on a bobbin on which a voice coil is wound, and a through hole drilled in the central portion of a center pole of the outer-magnet-type magnetic circuit inserted into the bobbin. The high temperature air inside the bobbin is dissipated through the through hole to the outside.

A dome speaker disclosed in Patent Document 2 has a very-small-diameter air vent formed through a diaphragm or an edge for adjustment of the back pressure of the diaphragm.

Patent Document 1: Japanese Patent application Laid-Open No. 2002-271889

Patent Document 2: Japanese Patent application Laid-Open No. 2002-247687

DISCLOSURE OF THE INVENTION

Problems to be Solved by the Invention

However, the technique disclosed in Patent Document 1 cannot be applied to, for example, a speaker comprising a dome diaphragm or a speaker comprising an internal-magnet-type magnetic circuit, because a through hole is provided in a speaker with the external-magnet-type magnetic circuit or the cone diaphragm.

In the dome speaker described in Patent document 2, because very-small-diameter air vents are formed through the diaphragm or edge, unwanted sound produced on the back of the diaphragm is unfortunately emitted through the air vent to the sound radiation side, resulting in a reduction in sound quality.

When the magnetic circuit is arranged on the frame in the process of assembling a speaker device, high accuracy is required for the positioning of the magnetic circuit on the frame. In general, because a special jig intended for the positioning is used in assembling the speaker, a complicated operation and operational time required for achieving the positioning are required.

In addition, when, for example, a sound absorbing material is disposed on the magnetic circuit for the purpose of reducing unwanted sound inside the dome diaphragm, the use of a jig intended for the positioning of the sound absorbing material is required in the assembling process. Accordingly, a speaker device which is capable of being assembled more simply has been desired.

An example of the challenges facing the present invention is to address the problems as described above. Specifically, it is an object of the present invention is to provide a simple structure which will achieve dissipation of heat from the area inside a voice-coil bobbin and a diaphragm without a reduction in sound quality, a process for assembling a speaker device with high accuracy in a simple operation, and the like.

Means for Solving the Problems

To attain this object, the present invention comprises at least a structure according to each of the following independent claims.

According to an invention as described in claim 1, there is provided a speaker device comprising a recess-shaped frame supporting, through an edge, a vibration system member provided with a diaphragm coupled to a voice-coil bobbin, and a magnetic circuit including an approximately ring-shaped magnet and an approximately ring-shaped plate which are mounted on a yoke disposed in the frame, and a magnetic gap in which a voice coil wound on the voice-coil bobbin is disposed, wherein the magnetic circuit is positioned and fixed with respect to the frame by fitting a through hole, which extends in a vibration direction of the diaphragm, over a protrusion of a shape protruding from the bottom of the frame in a direction of sound emission, and wherein an air passage providing communication between the area inside the voice-coil bobbin and the outside of the frame is formed along the protrusion fitted into the through hole of the magnetic circuit.

According to an invention as described in claim 17, there is provided a speaker unit comprising a main speaker device and a tweeter speaker device, wherein the tweeter speaker device comprises a recess-shaped frame supporting, through an edge, a vibration system member provided with a diaphragm coupled to a voice-coil bobbin, and a magnetic circuit including an approximately ring-shaped magnet and an approximately ring-shaped plate which are mounted on a yoke disposed in the frame, and a magnetic gap in which a voice coil wound on the voice-coil bobbin is disposed. The magnetic circuit is positioned and fixed with respect to the frame by fitting a through hole, which extends in a vibration direction of the diaphragm, over a protrusion of a shape protruding from the bottom of the frame in a direction of sound emission. An air passage providing communication between the area inside the voice-coil bobbin and the outside of the frame is formed along the protrusion fitted into the through hole of the magnetic circuit.

THE BEST MODE FOR CARRYING OUT THE INVENTION

Figure 1:
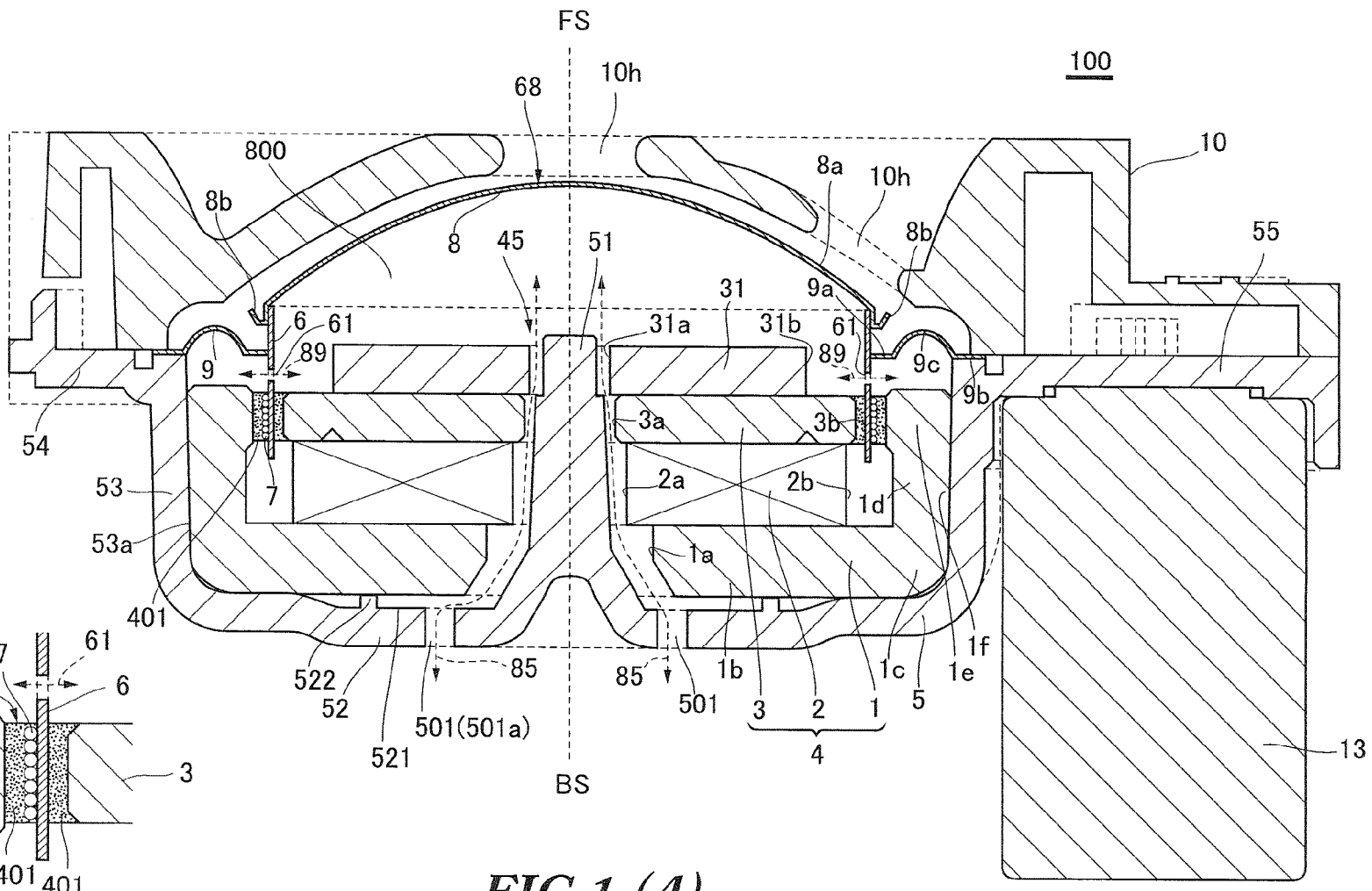
FIG. 1 consists of diagrams for illustrating a speaker device 100 according to a first embodiment of the present invention, specifically, FIG. 1(A) which is a sectional view for illustrating the speaker device according to the first embodiment of the present invention, and FIG. 1(B) which is a diagram for illustrating a magnetic fluid 401 interposed in a magnetic gap 4*g*.
Figure 1:
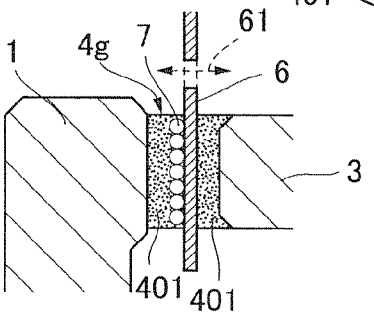

A speaker device according to an embodiment of the present invention is a speaker device comprising a recess-shaped frame supporting through an edge a vibration system member comprising a diaphragm coupled to a voice-coil bobbin, and a magnetic circuit comprising an approximately ring-shaped magnet and an approximately ring-shaped plate which are mounted on a yoke disposed in the frame, and a magnetic gap in which a voice coil wound on the voice-coil bobbin is disposed, and characterized in that the magnetic circuit is positioned and fixed with respect to the frame by fitting a through hole, which extends in a vibration direction of the diaphragm, over a protrusion of a shape protruding from the bottom of the frame in a direction of sound emission, and in that an air passage providing communication between the area inside the voice-coil bobbin and the outside of the frame is formed along the protrusion fitted into the through hole of the magnetic circuit.

The speaker device according to present invention is preferably applied to a small-sized speaker device such as a tweeter speaker device in a speaker unit having a main speaker device and a tweeter speaker device.

In the speaker device of the aforementioned structure, the through hole extending in the vibration direction of the diaphragm is fitted over the protrusion of a shape protruding from the bottom of the frame toward the sound emission side, so that the magnetic circuit is positioned and fixed with respect to the frame. Accordingly, it is possible to mount the magnetic circuit to the frame with high accuracy in a simple operation.

In the speaker device of the aforementioned structure, because the air passage is provided along the protrusion fitted into the through hole of the magnetic circuit for communication between the inside of the voice-coil bobbin and the outside of the frame, it is possible to dissipate heat in the area inside the voice-coil bobbin and inside the diaphragm with a simple structure without a reduction in sound quality.

Speaker devices according to an embodiment of the present invention will be described below with reference to the drawings.

First Embodiment

FIGS. 1(A), 1(B) are diagrams for illustrating a speaker device 100 according to a first embodiment of the present invention. Specifically, FIG. 1(A) is a sectional view for illustrating the speaker device according to the first embodiment of the present invention, and FIG. 1(B) is a diagrams for illustrating a magnetic fluid 401 placed in a magnetic gap 4*g*.

As illustrated in FIGS. 1(A) and 1(B), the speaker device 100 according to an embodiment of the present invention has a magnetic circuit 4 comprising a yoke 1, a magnet 2 and a plate 3, a frame (speaker frame) 5, a voice-coil bobbin 6, a voice coil 7, a diaphragm 8, an edge 9 and an equalizer 10.

The yoke 1 corresponds to an embodiment of a yoke according to the present invention, and the magnet 2 corresponds to an embodiment of a magnet according to the present invention. The plate 3 corresponds to an embodiment of a plate according to the present invention, and the magnetic circuit 4 corresponds to an embodiment of a magnetic circuit according to the present invention. The frame 5 corresponds to an embodiment of a frame according to the present invention, and the voice-coil bobbin 6 corresponds to an embodiment of a voice-coil bobbin according to the present invention. The voice coil 7 corresponds to an embodiment of a voice coil according to the present invention, the diaphragm 8 corresponds to an embodiment of a diaphragm according to the present invention, and the edge 9 corresponds to an embodiment of an edge according to the present invention.

[Magnetic Circuit 4]

The magnetic circuit 4 according to the present embodiment has a through hole 45 formed in the central portion, and is positioned and fixed with respect to the frame 5 by use of a protrusion (center boss 51) provided on the frame 5 which will be described later. The through hole 45 and the protrusion (center boss 51) of the frame 5 are provided on the center axis o in the speaker device 100 according to the present embodiment, but the through hole and the protrusion of the frame are not limited to this form.

For the magnetic circuit 4, an interior-magnet-type magnetic circuit, an exterior-magnet-type magnetic circuit, a magnetic circuit of a combination of the two types, or the like can be employed. The present embodiment employs the interior-magnet-type magnetic circuit 4. Each of the components of the magnetic circuit 4 will be described below in detail with reference to the drawings.

As illustrated in FIG. 1(A), the yoke 1 according to the present embodiment is disposed in the frame 5, and has a flat plate shaped bottom 1*b* which is joined to the bottom face of the approximately ring-shaped magnet 2, and a side portion 1*d* which has a shape bending from an outer peripheral end 1*c* in the direction of the sound radiation (the front face) and then extending as far up as the side of the plate 3. The bottom 1*b* and the side portion 1*d* are molded in one piece. In addition, as described later, the magnetic gap 4*g* is formed between the inner periphery of the upper end 1*e* of the side portion 1*d* and the outer periphery of the plate 3. The speaker device 100 according to the present embodiment has a structure in which the outer periphery 1*f* of the side portion 1*d* of the yoke 1 is fixedly attached to the side portion of the frame 5 by use of an adhesive or the like.

In the bottom 1*b* according to the present embodiment, an approximately circular shaped hole having its center on the center axis o is formed. Specifically, the inner periphery 1*a* in the bottom 1*b* has an inclined-face portion shaped so that the opening diameter increases toward the back face. As materials for forming the yoke 1, for example, a magnetic material such as an inorganic material, metal or iron or the like can be employed.

As shown in FIG. 1(A), the magnet 2 is formed in an approximate ring shape and placed on the yoke 1. In the magnet 2, specifically, the inner diameter of an inner periphery 2*a* is set to be smaller than the inner diameter of the inner periphery 1*a* of the yoke 1 and the outer diameter of the outer periphery 2*b* is set to be smaller than the inner diameter of the side portion 1*d* of the yoke 1 as shown in FIG. 1(A). As the magnet 2, for example, a permanent magnet such as a magnet of the neodymium system, samarium-cobalt system, AlNiCo system, ferrite system or the like can be employed.

The plate 3 is formed in an approximate ring shape and placed on the magnet 2 as shown in FIG. 1(A). Specifically, in the plate 3, the inner diameter of an inner periphery 3*a* is set to be smaller than the inner diameter of the magnet 2 and the outer diameter of the outer periphery 3*b* is set greater than the outer diameter of the magnet 2 as shown in FIG. 1(A). As materials for forming the plate 3, for example, a metal such as iron can be employed. In addition, a recessed portion shaped in a triangular cross-section is formed in the joint face of the plate 3 on the magnet 2 along the peripheral direction. The recessed portion is used to prevent an adhesive from seeping out when the plate 3 and the magnet 2 are bonded together.

As shown in FIG. 1(A), the magnetic circuit 4 according to the present embodiment has a through hole 45 extending in the vibration direction of the diaphragm 8 as described above. In the magnetic circuit 4 according to the present embodiment, as shown in FIG. 1(A), the yoke 1, the magnet 2 and the plate 3 are arranged concentrically with respect to the center axis o, and specifically, are coaxially disposed close to each other in a position in which they are stacked up in the center axis o. The respective holes of the yoke 1, the magnet 2 and the plate 3 are formed concentrically with each other with respect to the center axis o. In the present embodiment, as described above, the inner diameter of the ring-shaped magnet 2 is predetermined to be larger than the inner diameter of the approximately ring-shaped plate 3, and in turn the inner diameter of the hole of the yoke 1 is predetermined to be larger than the inner diameter of the ring-shaped magnet 2.

A sound absorbing material 31, which will be described later, is disposed on the plate 3. The sound absorbing material 31 according to the present embodiment is formed in a ring shape as shown in FIG. 1(A), and has an inner peripheral portion 31*a* of which the inner diameter is determined to be smaller than the inner diameter of the plate 3, and an outer peripheral portion 31*b* of which the outer diameter is determined to be smaller than the outer diameter of the plate 3. That is, the sound absorbing material 31 has a hole drilled therein and fitted over the center boss 51 of the frame 5.

As shown in FIG. 1(A), the sound absorbing material 31 has the function of reducing unwanted sound caused in an approximately hermetically sealed space 800 created inside the diaphragm 8, specifically in the space 800 enclosed by the diaphragm 8, the voice-coil bobbin 6 and the plate 3. As materials for forming the sound absorbing material 31, for example, materials having a sound absorbing function such as felt, urethane or the like can be employed.

As shown in FIGS. 1(A), 1(B), the magnetic circuit 4 of the aforementioned structure has a magnetic gap 4*g* for driving the voice coil 7. Magnetic flux is concentrated in this magnetic gap 4*g*. The magnetic gap 4*g* is formed between the inner periphery of the upper end 1*e* of the side portion 1*d* and the outer periphery of the plate 3, and with an approximately uniform gap all round.

[Magnetic Fluid 401]

Regarding the magnetic circuit 4 according to the present embodiment, as shown in FIGS. 1(A), 1(B), a magnetic fluid 401 is interposed in the magnetic gap 4*g*. The magnetic fluid 401 is, for example, a colloidal solution of fine ferromagnetic particles uniformly dispersed in a liquid (solvent) by use of a surface-active agent or the like. The magnetic fluid 401 functions as an entire liquid having ferromagnetism in a high magnetic field, and functions as a liquid without magnetism because of thermal disturbance in the zero magnetic field. As a solvent for obtaining the magnetic fluid 401, various types of materials, for example, polyolefin, silicone resin and the like, can be employed as appropriate. Any magnetic fluid 401 with a viscosity ranging, for example, from about 100 to about 200 mPa·sec (30° C.) is acceptable. Various characteristics of the magnetic fluid 401, such as those relating to viscosity, magnetic characteristics and relative density, are determined as appropriate on the basis of the environment of use of the speaker device 100 and the like.

By means, for example, of magnetic force, surface tension and/or the like, the magnetic fluid 401 is interposed in the magnetic gap 4*g*, specifically, between the plate 3 and the voice-coil bobbin 6 and also between the voice-coil bobbin 6 and the yoke 1, and is disposed so as to encompass the voice coil 7, as shown in FIGS. 1(A), 1(B). The magnetic fluid 401 has a viscosity determined as appropriate to cause the amount of vertical vibration of the voice coil 7 to be approximately proportional to the amplitude of the audio electric current. The magnetic fluid 401 also serves as a damper for the voice-coil bobbin 6. In addition, the magnetic fluid 401 has the function of dissipating the heat of the voice coil 7 on passage of the audio electric current toward the plate 3, the yoke 1 and the like.

As described above, because the speaker device 100 has the structure in which the magnetic fluid 401 is interposed in the magnetic gap 4*g* of the magnetic circuit 4, the speaker device 100 is capable of dissipating the heat of the voice coil 7 on passage of the audio electric current toward the plate 3, the yoke 1 and the like.

[Frame 5]

FIGS. 2(A), 2(B) are diagrams for illustrating the frame 5 of the speaker device shown in FIG. 1(A). Specifically, FIG. 2(A) is a sectional view of the frame of the speaker device shown in FIG. 1(A), and FIG. 2(B) is a diagrams for illustrating a fluid stopper protrusion illustrated in FIG. 2(A). FIG. 3 is a top view of the frame shown in FIG. 2(A) when viewed from the sound radiation side. FIG. 4 is a rear view of the frame shown in FIG. 2(A) when viewed from the back side (opposite to the sound radiation side). Specifically, FIG. 2(A) is a sectional view taken along the A-A line of the frame 5 shown in FIG. 3.

As illustrated in FIG. 1 to FIG. 4, the frame 5 is shaped in a recess form and supports a vibration system member 68 comprising the diaphragm 8 coupled to the voice-coil bobbin 6 by the interposition of the edge 9. The frame 5 allows the magnetic circuit 4 to be located inside the frame 5.

Specifically, the frame 5 has a center boss 51, a bottom 52, a side portion 53, a flange 54 and a mounting portion 55 as shown in FIG. 1 to FIG. 4. The center boss 51 corresponds to an embodiment of a protrusion according to the present invention. The bottom 52 corresponds to an embodiment of a bottom according to the present invention.

As materials for forming the frame 5, for example, a polymeric material such as a resin or a metallic material can be employed. The frame 5 in the present embodiment is formed of a polymeric material such as a resin. In the present embodiment, the center boss 51, the bottom 52, the side portion, the flange 54 and the mounting portion 55 are molded in one piece.

The center boss (protrusion) 51 is formed in a shape protruding toward the sound emission side from the bottom 52 of the frame 5 along the center axis o, for example. The center boss 51 is formed in a shape which extends from the bottom of the frame 5, is then fitted into the through hole 45 of the magnetic circuit 4, and then extends above the plate 3.

The center boss 51 is fitted into the through hole 45 formed in the magnetic circuit 4. In other words, the through hole 45 is fitted over the center boss 51 formed on the bottom 52 of the frame 5, so that the magnetic circuit 4 is positioned and fixed with respect to the frame 5. In the present embodiment, the magnetic circuit 4 is fitted to the frame 5, leaving a gap between the outer periphery of the center boss (protrusion) 51 of the frame 5 and the inner periphery of the through hole 45 of the magnetic circuit 4.

As shown in FIG. 1 to FIG. 4, the center boss 51 according to the present embodiment is formed in an approximately cylindrical shape coaxial with the center axis o. Specifically, the center boss 51 has an upper cylindrical portion 511, an intermediate cylindrical portion 512, a lower cylindrical portion 513 and a recessed portion 514, as shown in FIG. 1 to FIG. 4.

The upper cylindrical portion 511 has a diameter determined to be smaller than the inner diameter of the sound absorbing material 31 in order to achieve the positioning of the sound absorbing material 31. The intermediate cylindrical portion 512 has a diameter determined to be smaller than the inner diameters of the magnet 2 and the plate 3 in order to achieve the positioning of the magnet 2 and the plate 3. The lower cylindrical portion 513 has a diameter determined to be smaller than the inner diameter of the yoke 1 in order to achieve the positioning of the yoke 1. The lower cylindrical portion 513 according to the present embodiment is formed in an approximately conical shape corresponding to the shape of the hole of the yoke 1, and the recessed portion 514 is formed in the back side. That is, a gap is formed between the outer periphery of the center boss (protrusion) 51 of the frame 5 and the inner periphery of the yoke 5 of the magnetic circuit 4.

The bottom 52 is formed in an approximately flat plate shape as shown in FIG. 1 to FIG. 4. The magnetic circuit 4 including the yoke 1 and so on is mounted on the bottom 52. Specifically, the bottom 52 has a recessed portion 521, a fluid stopper protrusion 522, a fluid basin 523, ribs 524, and grooves 525 as shown in FIG. 1 to FIG. 4.

The recessed portion 521 corresponds to an embodiment of a gap formed between the frame 5 and the bottom face of the yoke 1 according to the present invention. The fluid stopper protrusion 522 corresponds to an embodiment of a ring-shaped protrusion. The fluid basin 523 and the grooves 525 correspond to an embodiment of a fluid basin according to the present invention.

The recessed portion 521 is formed in an approximately circular shape around the center of the bottom 52 of the frame 5, so that a gap is constituted with respect to the bottom face of the yoke 1 of the magnetic circuit 4. Since the gap is provided between the frame 5 and the bottom face of the yoke 1 of the magnetic circuit 4, the speaker device 100 of the aforementioned structure is capable of improving the heat dissipation effect on the bottom face of the yoke 1.

Figure 2:
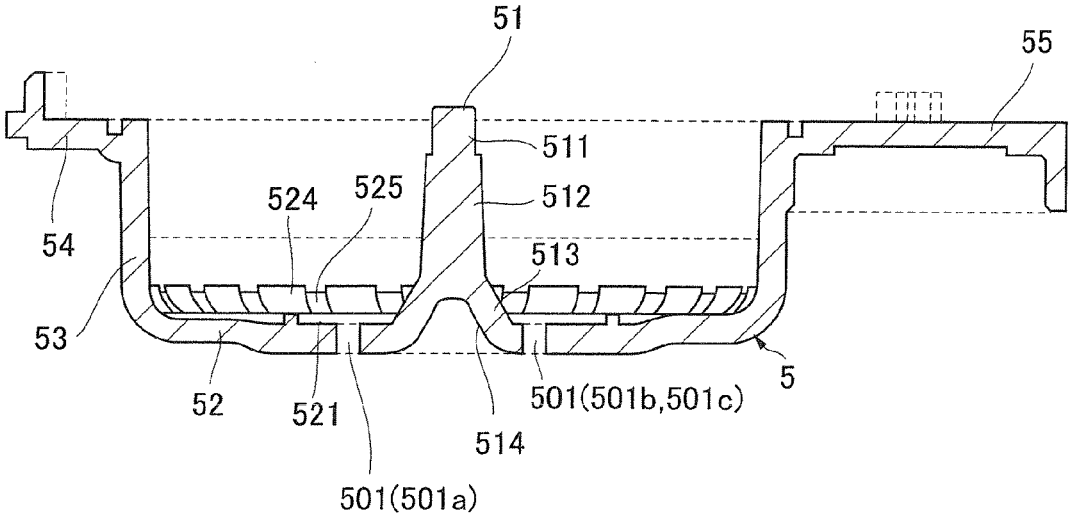
FIG. 2 consists of diagrams for illustrating a frame 5 of the speaker device illustrated in FIG. 1(A), specifically, FIG. 2(A) which is a sectional view of the frame 5 of the speaker device 100 shown in FIG. 1(A), and FIG. 2(B) which is a diagram for illustrating a fluid stopper protrusion shown in FIG. 2(A).
Figure 2:
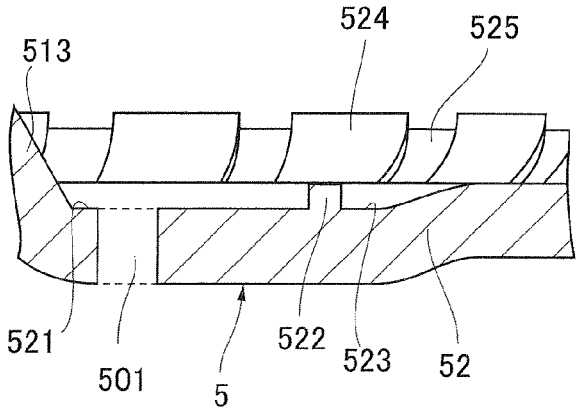
Figure 3:
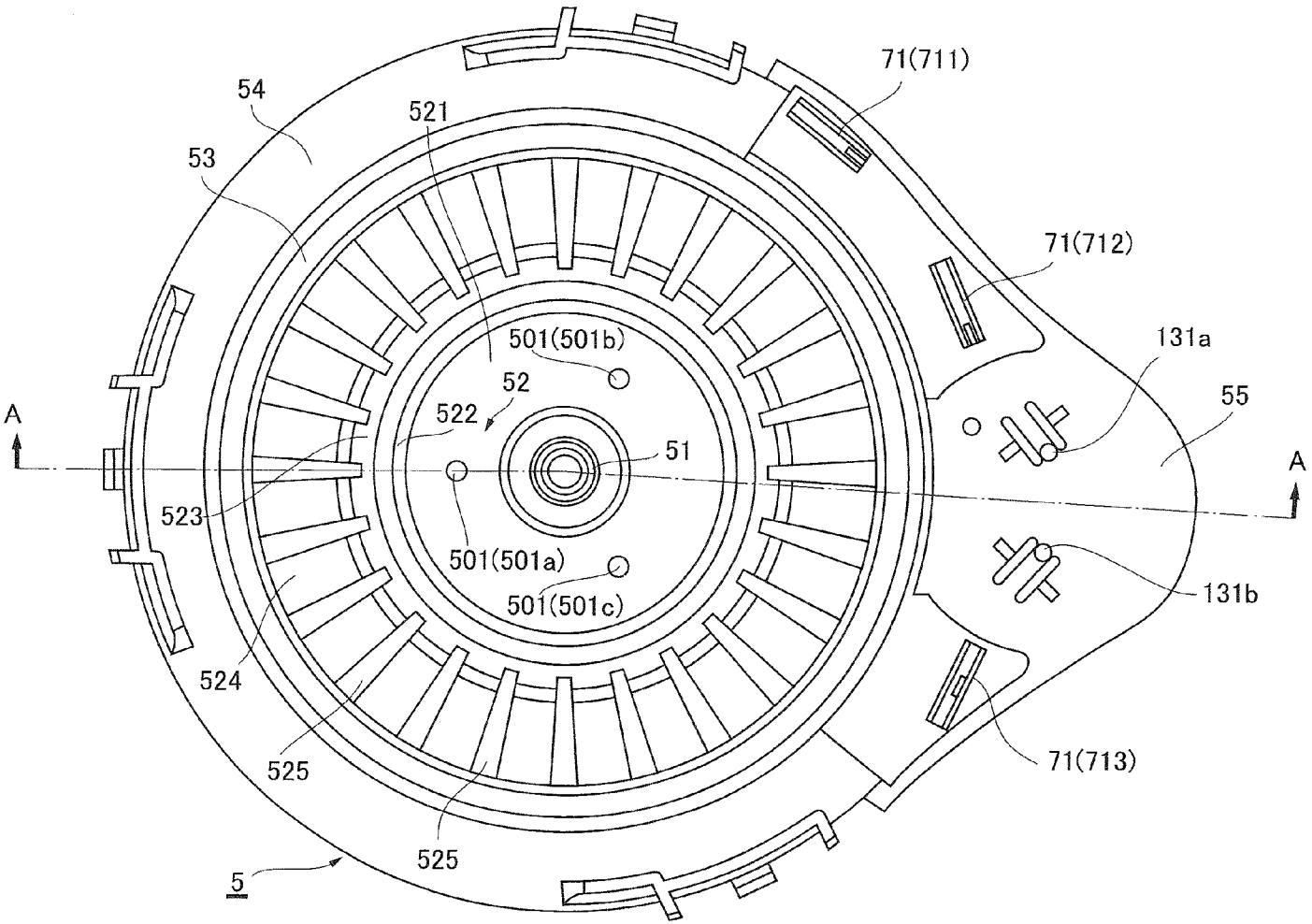
FIG. 3 is a top view of the frame shown in FIG. 2(A) when viewed from the sound radiation side.
Figure 4:
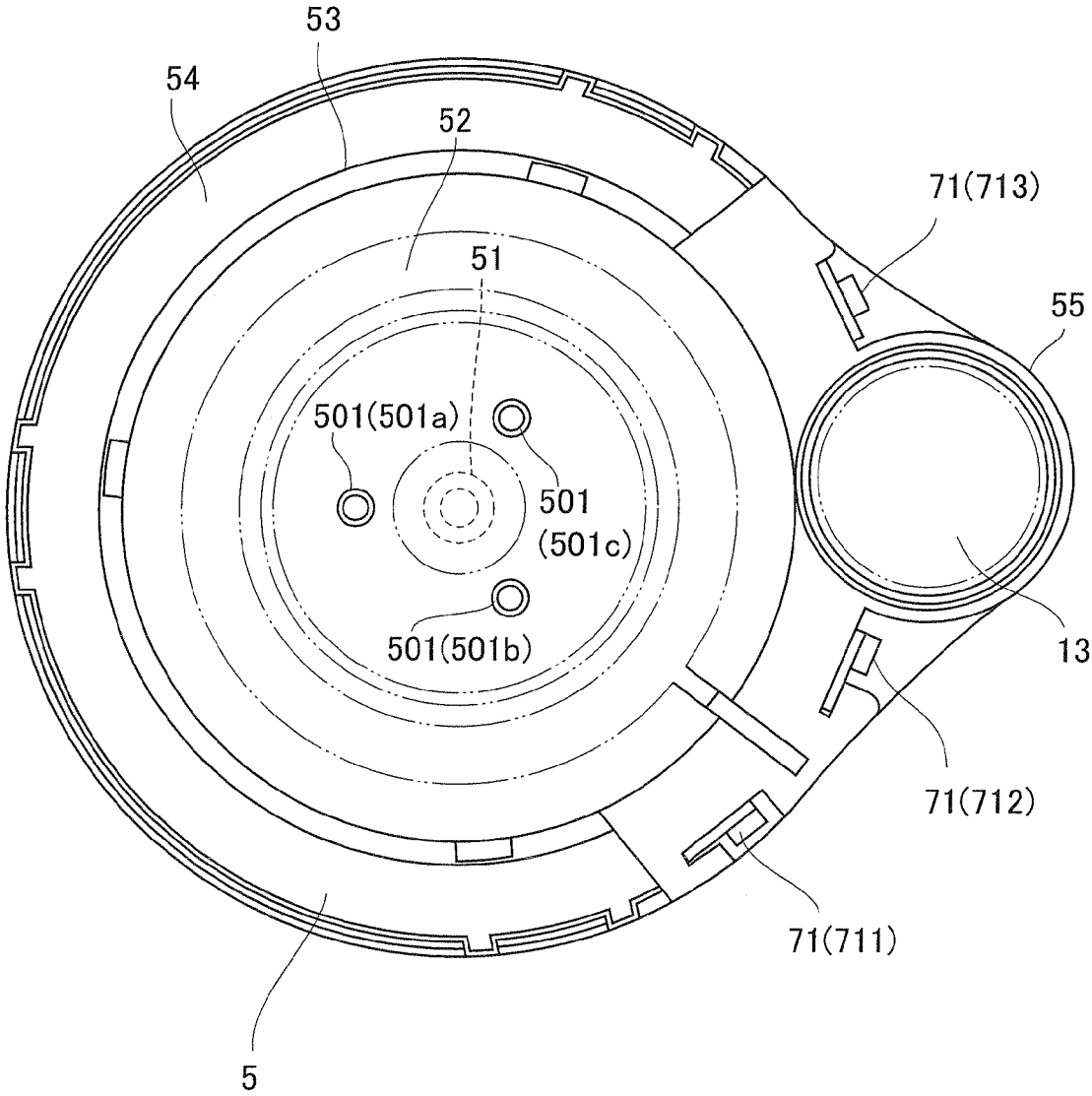
FIG. 4 is a rear view of the frame shown in FIG. 2(A) when viewed from the back side (opposite to the sound radiation side).

In addition, as shown in FIG. 1 to FIG. 3, air vents 501 are respectively provided in positions at a predetermined distance from the center boss 51 in the radial direction for communication between the outside of the frame and the gap formed between the recessed portion 521 and the bottom face of the yoke 1 of the magnetic circuit 4.

Regarding the air vents 501, specifically, as shown in FIG. 1 to FIG. 4, a plurality of air vents 501, three air vents 501*a*, 501*b*, 501*c* in the present embodiment, for communication between the gap and the outside of the frame, are provided in positions at a predetermined distance from the center boss 51 in the radial direction so as to be arranged in the peripheral direction. The air vents 501*a*, 501*b*, 501*c* are drilled in positions closer to the center than the position of the ring-shaped fluid-stopper protrusion 522.

As shown in FIG. 1 to FIG. 3, the fluid stopper protrusion 522 is formed in a ring shape extending in a circle in the peripheral direction in a position closer to the outer periphery than the positions of the air vents 501 in the gap formed between the bottom face of the yoke 1 and the frame, that is, in the recessed portion 521. Also the fluid stopper protrusion 522 protrudes from the bottom 52 of the frame 5 to the bottom face of the yoke 1 in the direction of the sound radiation.

The ring-shaped fluid-stopper protrusion 522 restrains the adhesive applied in between the frame 5 and the side portion 53 of the yoke 1 from flowing into the air vents 501 drilled through the bottom 52 of the frame 5.

As shown in FIG. 2(B) and FIG. 3, the fluid basin 523 is formed in a recess shape in a position closer to the outer periphery than the position of the approximately ring-shaped fluid-stopper protrusion 522 formed on the frame 5. The fluid basin 523 restrains the adhesive applied in between the frame 5 and the side face of the yoke 1 from flowing into the air vents 501 drilled through the bottom 52 of the frame 5.

As shown in FIG. 2(A), FIG. 2(B) and FIG. 3, the ribs 524 are provided in a radial arrangement in an area close to the bent portion in the frame 5, and are in contact with the bottom face of the yoke 1.

The grooves 525 are radially arranged and each formed between the ribs 524. The grooves 525 restrains the adhesive applied in between the frame 5 and the side face of the yoke 1 from flowing into the air vents 501 drilled through the bottom 52 of the frame 5.

As shown in FIG. 1 to FIG. 4, the side portion 53 is formed in a shape extending as far up as the side of the sound absorbing material 31 after bending from the outer peripheral end of the bottom 52 in the direction of the sound radiation (toward the front face). The side portion 53 is fixed to the outer periphery face of the side portion 1*d* of the yoke 1 by partially or fully coating the inner face 53*a* with an adhesive or the like.

The flange 54 is formed in a shape extending in a flat plate form from the upper end of the side portion 53 outward in the radial direction. As shown in FIG. 1(A), FIG. 3 and FIG. 4, the flange 54 according to the present embodiment has a mounting portion 55 formed at the outer periphery end.

Specifically, as shown in FIG. 1(A), FIG. 3 and FIG. 4, the mounting portion 55 has mounted on it, for example, a capacitor 13, a coil, a resistance element, a device such as a transistor, a circuit and/or the like. In the present embodiment, a high-pass filter capacitor 13 is mounted on the mounting portion 55. In addition, a plurality of electrodes 71 (711, 712, 713) are provided on the mounting portion 55 according to the present embodiment.

For example, when the speaker device 100 is adopted as a tweeter, the high-pass filter capacitor 13 is connected in series to the speaker. Specifically, for example, one of the two conductor wires drawn from the voice coil 7 is electrically connected to the electrode 711 (71) and the other conductor wire is electrically connected to the electrode 713 (71). One of the two electrodes 131*a*, 131*b* of the capacitor is connected to the electrode 712 (71), and the other electrode 131*b* of the capacitor is electrically connected to the electrode 713 (71). Each of the electrodes 711, 712 is electrically connected to a terminal (not shown) through the conductor wire.

The wiring of the speaker is not limited to the foregoing form. For example, when the capacitor is not adopted, one of the two conductor wires drawn from the voice coil 7 is electrically connected to the electrode 711 (71), and the other conductor wire is electrically connected to the electrode 712 (71).

As shown in FIG. 1(A), the voice-coil bobbin 6 is formed in an approximately tubular shape. The voice coil 7 is wound on a portion near an approximately lower end of the voice-coil bobbin 6, and the dome diaphragm 8 is coupled to the upper end of the voice-coil bobbin 6 so as to occlude the upper end.

As shown in FIG. 1(A) and FIG. 1(B), the voice-coil bobbin 6 is secured to the inner periphery of the edge 9 with an adhesive or the like. The voice-coil bobbin 6 has air vents 61 formed between the joint portion to the edge 9 and the portion on which the voice coil is wound. The air vents 61 form an air passage 89 making communication between the area inside the edge 9 and the insides of the voice-coil bobbin 6 and the diaphragm 8.

As shown in FIG. 1(A) and FIG. 1(B), the voice coil 7 is wound on the voice-coil bobbin 6 and disposed in the magnetic gap 4*g* of the magnetic circuit 4 so as to be vibratable therein.

The diaphragm 8 is formed in a dome shape as shown in FIG. 1(A), and coupled to the voice-coil bobbin 6 with an adhesive or the like in such a manner as to cover the upper end of the voice-coil bobbin 6. In addition, the diaphragm 8 has a bent portion formed at the end 8*b* of a dome-shaped central diaphragm portion 8*a*, and the bent portion is bent toward the sound emission side, as shown in FIG. 1(A).

For the diaphragm 8, for example, a hard dome diaphragm or a soft dome diaphragm may be employed. Acceptable hard dome diaphragms are molded by use of, for example, metal materials such as aluminum or titanium, plastic materials, ceramics materials, paper, phenol resin, fiber reinforced plastics (FRP), or the like. Acceptable soft dome diaphragms may be molded by impregnating, for example, cloth such as chemical fiber, cotton or silk with a resin.

The diaphragm 8 according to the present embodiment is formed, for example, with a relatively low air permeability, desirably, without air permeability.

The edge 9 is formed in a ring shape. An inner periphery 9*a* of the edge 9 is secured to the outer periphery of the voice-coil bobbin 6 or the outer periphery of the diaphragm 8. An outer periphery 9*b* is cemented to a portion of the frame 5 close to its upper end with an adhesive or the like. In addition, the edge 9 has a rounded portion 9*c* provided between the inner periphery 9*a* and the outer periphery 9*b*. The edge 9 according to the present embodiment is impervious to air.

The equalizer 10 has the function of effecting a certain change in various characteristics such as those relating to frequency, sound pressure, and sound-wave directivity of the speaker. As shown in FIG. 1(A), the equalizer 10 is disposed on the sound radiation side of the diaphragm 8, and secured to the upper portion of the frame 5 with an adhesive or the like. As shown in FIG. 1(A), the equalizer 10 has a plurality of holes 10*h* formed therein, so that the sound wave is emitted from the diaphragm 8 through the holes 10*h*.

[Sound Absorbing Material 31]

Figure 5:
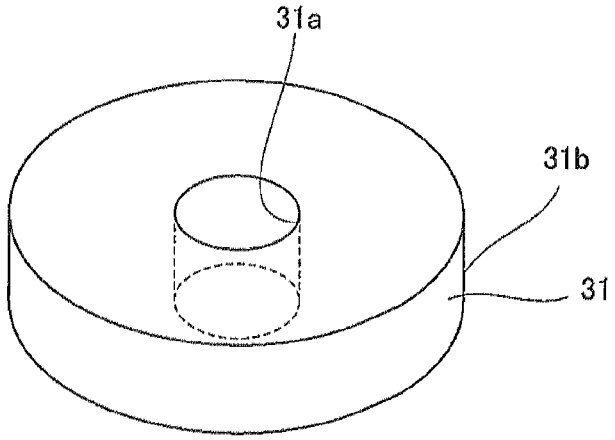
FIG. 5 consists of diagrams for illustrating a sound absorbing material 31 of the speaker device 100 shown in FIG. 1, specifically, FIG. 5(A) which is a diagram for illustrating the sound absorbing material 31 according to a first specific example, and FIG. 5(B) which is a diagram for illustrating a sound absorbing material 31A according to a second specific example.
Figure 5:
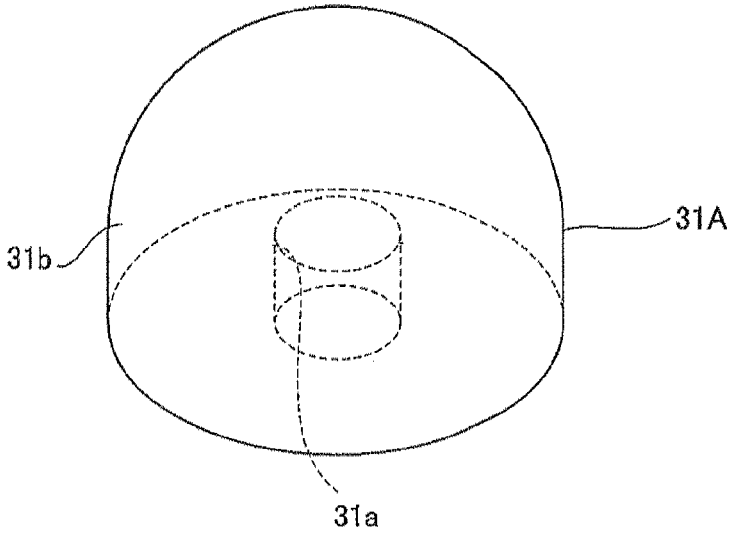

FIG. 5 consists of diagrams illustrating the sound absorbing material 31 of the speaker device 100 shown in FIG. 1. Specifically, FIG. 5(A) is a diagram illustrating the sound absorbing material 31 according to a first specific example, and FIG. 5(B) is a diagram illustrating a sound absorbing material 31A according to a second specific example.

The sound absorbing material 31 is mounted on the plate 3 as shown in FIG. 1(A), and has the function of reducing unwanted sound caused in the approximately hermetically sealed space 800 created inside the diaphragm 8, specifically in the space 800 enclosed by the diaphragm 8, the voice-coil bobbin 6 and the plate 3. The sound absorbing material 31 is formed in, for example, a ring shape as shown in FIG. 1(A). The inner diameter of the inner periphery 31*a* of the sound absorbing material 31 is determined to be of a predetermined length longer than the outer diameter of the center boss 51 of the frame 5, and the outer diameter of the outer periphery 31*b* is determined to be less than the inner diameter of the voice-coil bobbin 6. The height of the sound absorbing material 31 is determined to be less than at least a length obtained by subtracting the maximum amplitude of the diaphragm 8 from the distance between the plate 3 and the diaphragm 8. That is, a gap of a predetermined distance is formed between the inner periphery 31*a* of the sound absorbing material 31 and the outer periphery of the center boss 51 of the frame 5, which form part of an air passage 85.

The outer peripheral shape of the sound absorbing material 31 is not limited to a circular shape, and various shapes, for example, a polygonal shape such as a triangular shape and a rectangular shape, and an approximately elliptical shape, may be adopted. The inner peripheral shape of the sound absorbing material 31 is also not limited to a circular shape, and various shapes of a polygonal shape such as a triangular shape and a rectangular shape and an approximately elliptical shape, may be adopted. The shape of the center boss 51 is not limited to an approximately cylindrical shape, and various shapes, for example, a polygonal shape such as a triangular shape and a rectangular shape, and an approximately elliptical shape, may be adopted. The sound absorbing material 31 needs to be shaped to allow a gap of a predetermined distance to be created between the inner periphery 31*a* of the sound absorbing material 31 and the outer periphery of the center boss 51 and to achieve the positioning and the fixing of the sound absorbing material 31.

For example, as shown in FIG. 5(B), one may equally adopt a sound absorbing material 31A which has an upper portion formed in an approximately hemispherical shape and a lower portion formed in a ring shape. That is, a recessed portion is formed in the bottom of the sound absorbing material 31A. The inner diameter of an inner periphery 31*a* of the recessed portion and the outer diameter of the sound absorbing material 31A are the same as in the case of the sound absorbing material 31 shown in FIG. 5(A). In the sound absorbing material 31A of the above structure, a through hole is preferably formed to extend through the sound absorbing material 31A from the inside to the outside.

[Assembling Process]

Figure 6:
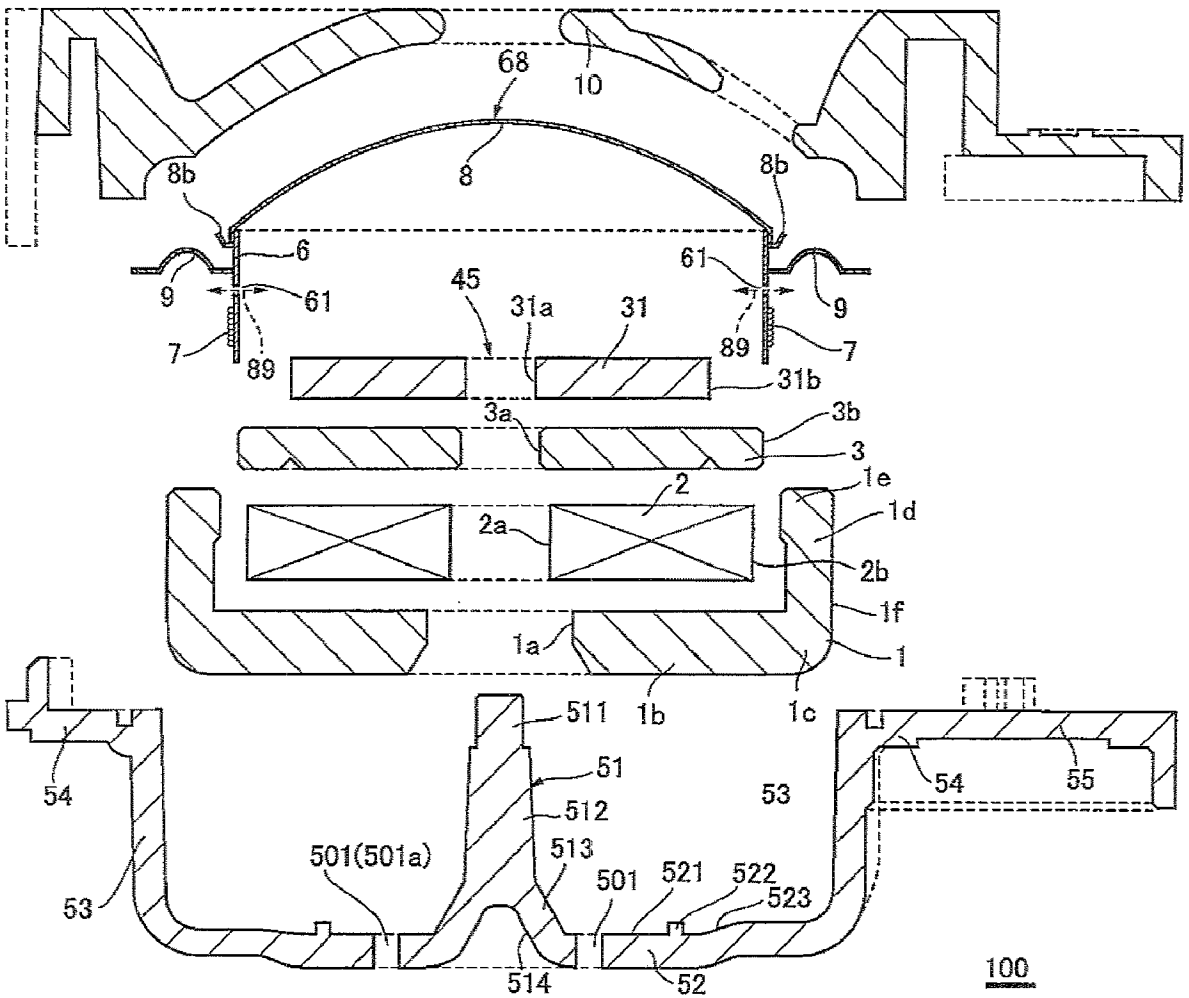
FIG. 6 is an exploded view of the speaker device 100 shown in FIG. 1.

FIG. 6 is an exploded view of the speaker device 100 shown in FIG. 1. The process of assembling the speaker device 100 according to the present embodiment will be described with reference to FIG. 1 to FIG. 6.

As shown in FIG. 6, the yoke 1, the magnet 2, the plate 3 and the sound absorbing material 31 are placed in this order on the frame 5 by use of the center boss 51 and the side portion 53 of the frame 5 as the references for the positioning. Specifically, the yoke 1, the magnet 2, the plate 3 and the sound absorbing material 31 are fitted over the center boss 51 at predetermined intervals, whereby the yoke 1, the magnet 2, the plate 3 and the sound absorbing material 31 are positioned and fixed with respect to the frame 5.

In the present embodiment, an adhesive is applied in between the outer periphery 1*f* of the side portion 1*d* of the yoke 1 and the inner periphery 53*a* of the side portion 53 of the frame 5 to secure the yoke 1 and the frame 5 to each other.

In this connection, in the case of employing an adhesive having fluidity, in the event of applying an amount of adhesive exceeding a predetermined amount, or the like, even if the adhesive moves between the frame 5 and the yoke 1 before, for example, the adhesive sets or solidifies, the adhesive accumulates in the fluid basin 523 and/or the grooves 535 which are formed in the bottom 52 of the frame 5, resulting in prevention of the adhesive from flowing into an inner area beyond the fluid stopper protrusion 522. That is, it is possible to reduce blockages of the air vents 501 caused by the adhesive in the process of assembling the speaker device 100.

By assembling the speaker device 100 as described above, it is possible to position and fix the yoke 1, the magnet 2, the plate 3 and the sound absorbing material 31 with high accuracy with respect to the center boss 51.

Then, the outer periphery of the voice-coil bobbin 6 and the inner periphery of the edge 9 are bonded together by an adhesive or the like and then the outer periphery of the edge 9 and the frame 5 are bonded together by an adhesive or the like, such that the voice coil 7 wound on the voice-coil bobbin 6 is located in the magnetic gap 4*g* formed in the magnetic circuit 4 and can vibrate therein, as shown in FIG. 1(A), FIG. 1(B) and FIG. 6. At this stage, as shown in FIG. 1(B), the magnetic fluid 401 is applied to the magnetic gap 4*g* formed between the outer periphery of the plate 3 and the inner periphery of the yoke 1 in the magnetic circuit 4. The magnetic fluid 401 is interposed in the magnetic gap 4*g*, specifically, between the plate 3 and the voice-coil bobbin 6 and also between the voice-coil bobbin 6 and the yoke 1, by means, for example, of magnetic force, surface tension and/or the like.

The conductor wires (not shown) drawn from the voice coil 7 are electrically connected to the electrodes provided on the frame 5. As necessary, devices such as the capacitor 13 are electrically connected to the electrodes.

Then, as shown in FIG. 1(A) and FIG. 6, the equalizer 10 is arranged in a predetermined position on the frame 5, and then the frame 5 and the equalizer 10 are cemented to each other by an adhesive.

In the speaker device 100 of the aforementioned structure, for example, an electric signal is applied from a terminal (not shown) to the voice coil 7, whereupon the electromagnetic action in accordance with the electric signal produces a drive force on the voice coil 7. The drive force is transmitted through the voice-coil bobbin 6 to the diaphragm 8, which then vibrates the diaphragm 8 in the vibrating direction (central axis direction). As a result of the vibration of the diaphragm 8, a sound wave is radiated toward the sound emission side.

In the speaker device 100 of the aforementioned structure, further, the magnetic fluid 401 interposed in the magnetic gap 4*g* of the magnetic circuit 4 has various functions, such as the function of setting the amount of vertical vibration of the voice coil 7 to be approximately proportional to the amplitude of, for example, an audio electric current during the speaker operation, the function of dissipating the heat from the voice coil 7 toward the plate 3, the yoke 1 and the like, and the damper function.

In the speaker device 100 of the aforementioned structure, further, the space 800 located on the opposite side of the diaphragm 8 to the sound radiation side, specifically, the space 800 enclosed by the diaphragm 8, the voice-coil bobbin 6, the sound absorbing material 31 and the plate 3, communicates with the outside of the speaker frame by means of the air passage 85 which is made up of the gap between the center boss 51 and the through holes of the sound absorbing material 31, plate 3, magnet 2 and the yoke 1, the gap between the yoke 1 and the bottom 52 of the frame 5, and the air vents 501 drilled through in the bottom 52 of the frame 5. Because of this communication, even during the speaker operation, a reduction in the amount of the change in the air pressure in the space 800 can be achieved, making it possible to reduce the rise in temperature in the space 800.

Further, the speaker device 100 has a structure having the air vents 61 drilled through the voice-coil bobbin 6 establishing communication between the area inside the edge 9, specifically, the space on the opposite side of the edge 9 to the sound emission side, and the space 800 inside the diaphragm 8. For this reason, a reduction in the amount of the change in the air pressure in the area inside the edge 9 can be achieved, making it possible to reduce the rise in temperature.

Second Embodiment

Figure 7:
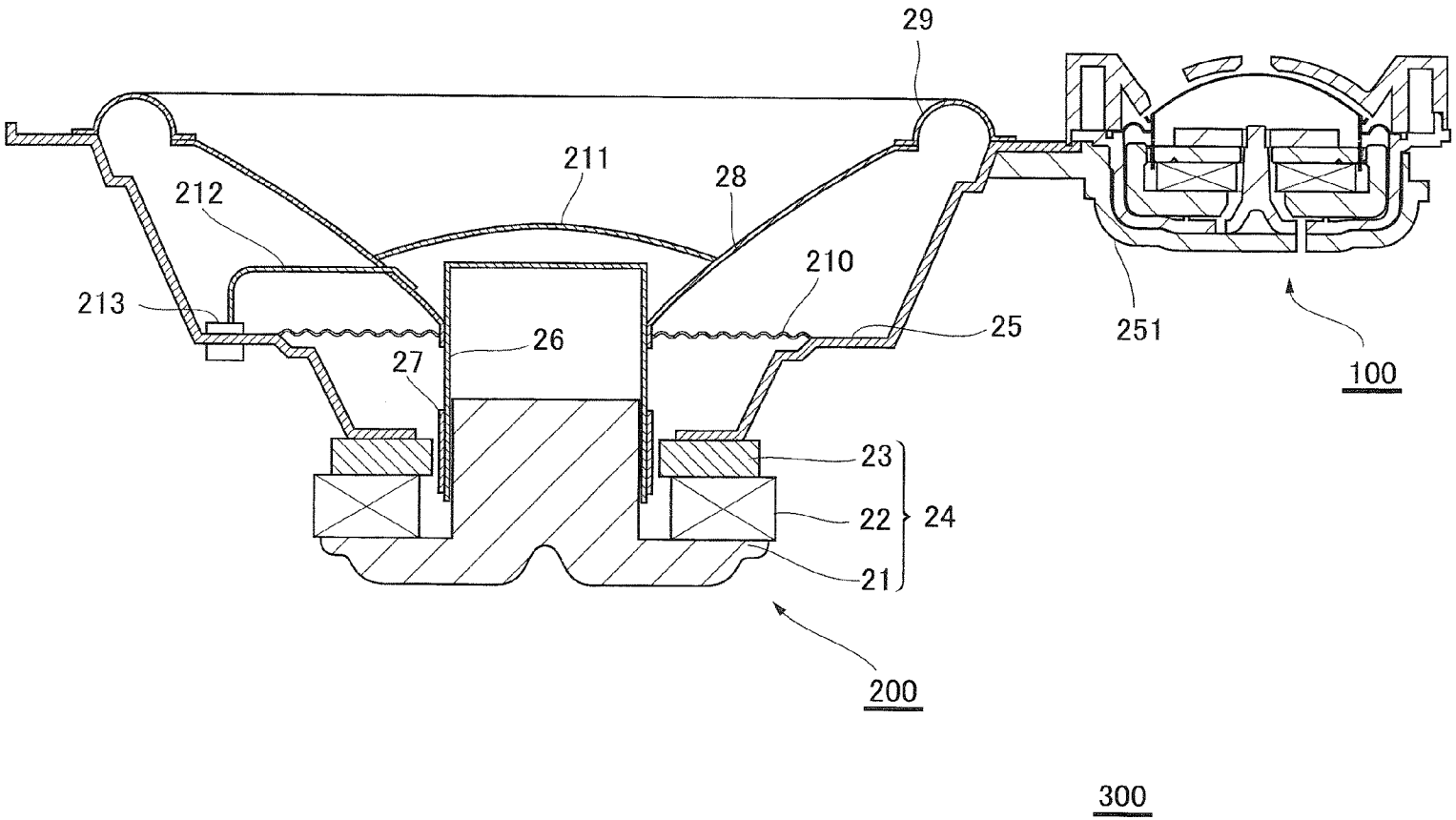
FIG. 7 is a sectional view for illustrating a speaker unit 300 according to a second embodiment of the present invention.
Figure 8:
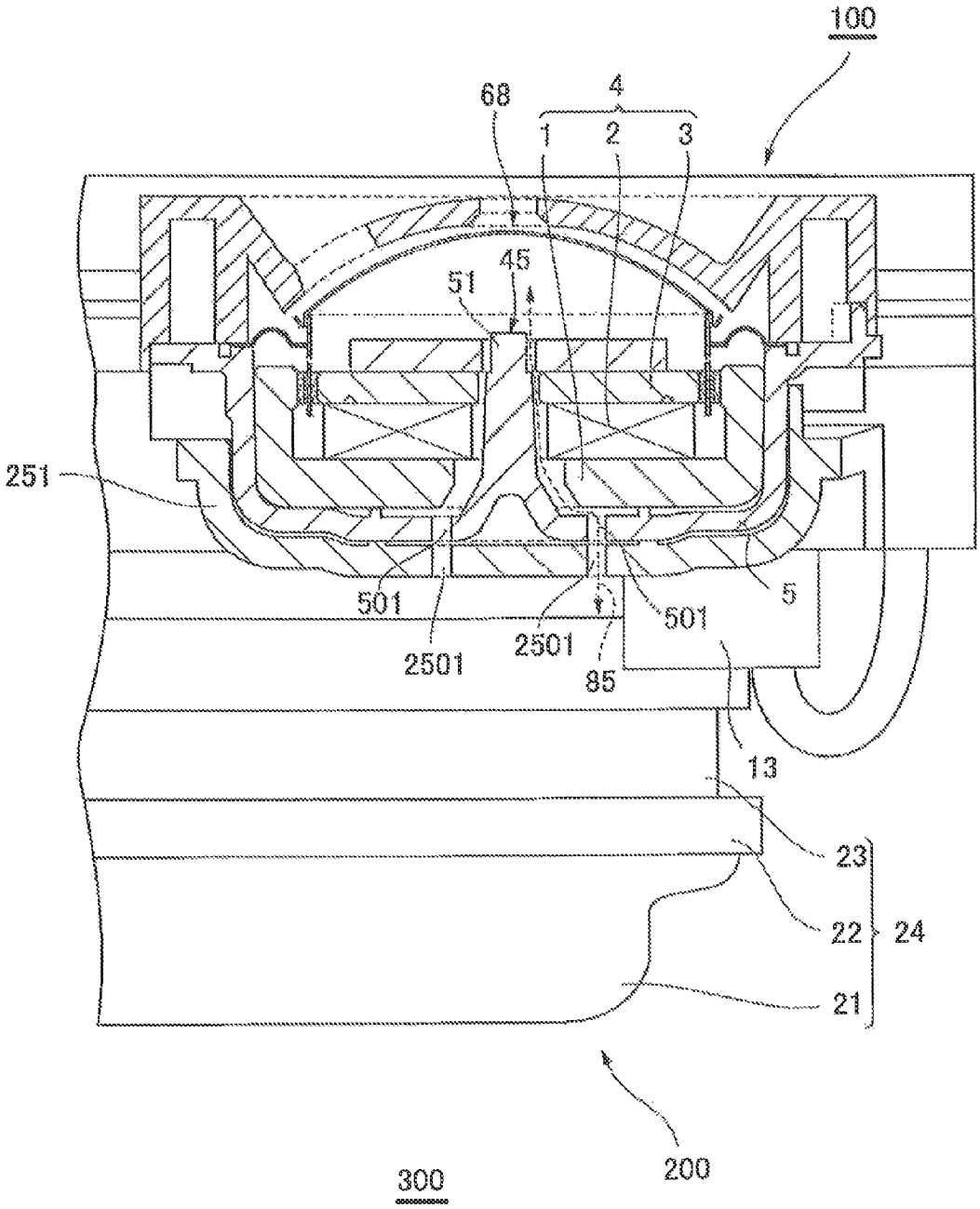
FIG. 8 is an enlarged sectional view of an area of the speaker unit 300 shown in FIG. 7 around a tweeter (speaker device 100).
Figure 9:
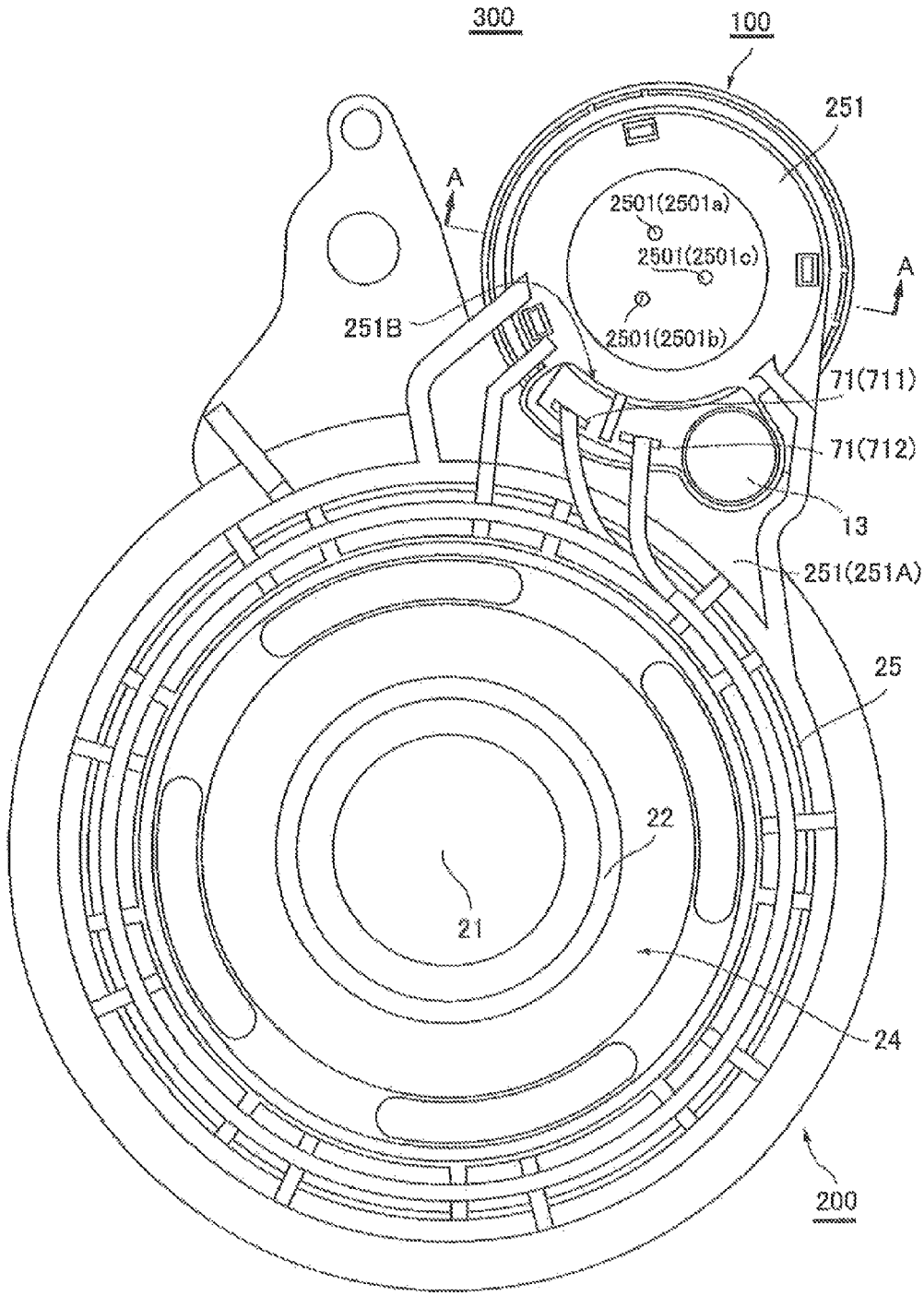
FIG. 9 is a rear view of the speaker unit 300 shown in FIG. 7.
Figure 10:
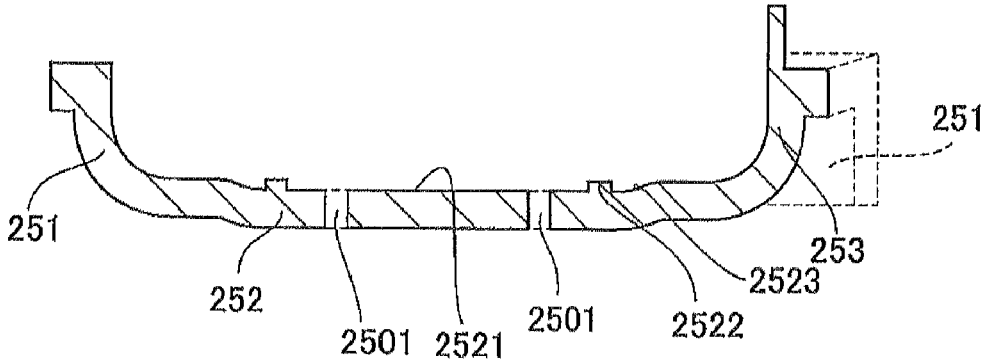
FIG. 10 consists of diagrams for illustrating a bracket 251 of the speaker unit 300 shown in FIG. 7, specifically, FIG. 10(A) which is a sectional view of the bracket 251 of the speaker unit 300 shown in FIG. 7, and FIG. 10(B) which is an enlarged view of an area of the bracket 251 shown in FIG. 10(A) around an air vent 2501.
Figure 10:
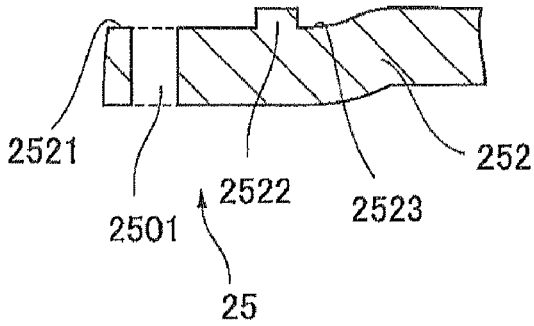

FIG. 7 is a sectional view illustrating a speaker unit 300 according to a second embodiment of the present invention. FIG. 8 is an enlarged sectional view of an area of the speaker unit 300 shown in FIG. 7 around a tweeter (speaker device 100). FIG. 9 is a rear view of the speaker unit 300 shown in FIG. 7. FIGS. 10(A), 10(B) are views illustrating a bracket 251 of the speaker unit 300 shown in FIG. 7. Specifically, FIG. 10(A) is a sectional view of the bracket 251 of the speaker unit 300 shown in FIG. 7. FIG. 10(B) is an enlarged view of an area of the bracket 251 shown in FIG. 10(A) around an air vent 2501.

As shown in FIG. 7 to FIGS. 10(A), 10(B), the speaker unit 300 according to the present embodiment has a main speaker device 200 and a tweeter (speaker device 100 for high frequency range).

The speaker unit 300 corresponds to an embodiment of a speaker unit according to the present invention, and the tweeter (speaker device 100 for high frequency range) corresponds to an embodiment of a tweeter speaker device according to the present invention. The speaker device 300 has the same structure and functions as those of the speaker device 100 according to the foregoing first embodiment, and a description is omitted.

The speaker device 100 serving as the tweeter is coupled to the main speaker device 200 through the mounting member (bracket) 251, as shown in shown in FIG. 7 to FIGS. 10(A), 10(B). Details of the bracket 251 will be described later.

[Main Speaker Device 200]

The main speaker device 200 functions, for example, as a speaker for low frequency range, and comprises a diaphragm having a larger diameter than that of the diaphragm 8 of the speaker device 100.

For example, as shown in FIG. 7 to FIG. 9, the main speaker device 200 has a magnetic circuit 24 having a yoke 21, a magnet 22 and a plate 23, a frame 25, a voice-coil bobbin 26, a voice coil 27, a diaphragm 28, an edge 29, a damper 210, a center cap 211, a conductor wire 212 and a terminal 213.

For the magnetic circuit 24, an exterior-magnet-type magnetic circuit, an interior-magnet-type magnetic circuit, or the like can be employed. The present embodiment employs the exterior-magnet-type magnetic circuit.

As shown in FIG. 7, the magnetic circuit 24 has a yoke 21 made up of a center pole which is erected approximately in the center portion of the speaker device 200 and a bottom yoke which spreads outward from the base end of the center pole in the radial direction and is molded integrally with the center pole, a ring-shaped magnet 22 which is a permanent magnet and is provided coaxially with and around the center pole, and a top plate 23 which is placed on the magnet 22 and is provided coaxially with and around the center pole. In the magnetic circuit 24, the voice coil 27 wound on the voice-coil bobbin 26 is disposed in the magnetic gap.

The voice-coil bobbin 26 is supported by the frame 25 through the damper member 210 which comprises, for example, a spider or the like, and can vibrate in the axis direction (the center axis direction of the center pole). The approximate center portion of the diaphragm 28 is secured to a portion of the voice-coil bobbin 26 close to its upper end. The outer periphery of the diaphragm 28 is connected through the edge 29 to the frame 25 by use of an adhesive or the like. The frame 25 is mounted on the face of the top plate 23 facing the diaphragm 28. The center cap 211 is disposed above the top of the voice-coil bobbin 26 and in the central portion of the diaphragm 28. The conductor wire 212 drawn from the voice coil 27 is electrically connected to the terminal 213 provided on the frame 25.

As shown in FIG. 7 to FIGS. 10(A), 10(B), the speaker unit 300 has a mounting member (also called a "bracket") 251 through which the main speaker device 200 and the tweeter speaker device 100 are coupled. The bracket 251 corresponds to an embodiment of a mounting member according to the present invention.

[Bracket (Mounting Member) 251]

As shown in FIG. 7 to FIGS. 10(A), 10(B), the bracket 251 is formed in a recess shape and has air vents 2501 communicating with the air passage 85 of the tweeter speaker device 100 which is disposed in the bracket 251.

As regards the details of the bracket 251, as shown in FIG. 7 to FIGS. 10(A), 10(B), specifically, a gap is formed between the bracket 251 and the bottom face of the speaker device 100 of the tweeter. The air vents 2501 through which the gap and the outside of the bracket 251 (the outside of the mounting member) communicate with each other are formed in positions corresponding to the air vents 501 which are formed in the frame 5 of the speaker device 100 of the tweeter.

As materials for forming the bracket 251, for example, a polymeric material such as a resin or metallic material can be employed. The bracket 251 in the present embodiment is formed of a polymeric material such as a resin.

Specifically, as shown in FIG. 7 to FIGS. 10(A), 10(B), the bracket 251 has a bottom 252 and a side portion 253. The bottom 252 and the side portion 253 are molded in one piece.

The bottom 252 is formed, for example, in an approximate flat plate shape, and the speaker device 100 is mounted on the bottom 252. Specifically, as shown in FIGS. 10(A), 10(B), the bottom 252 has a recessed portion 2521, a fluid stopper protrusion 2522 and a fluid basin 2523.

The recessed portion 2521 corresponds to an embodiment of the gap formed between the recessed portion and the bottom of the speaker device of the tweeter according to the present invention. The fluid stopper protrusion 2522 corresponds to an embodiment of the ring-shaped protrusion formed on the bracket 251.

The recessed portion 2521 is formed in an approximately circular shape around the central portion of the bottom of the bracket 251, and defines the gap in conjunction with the bottom of the speaker device 100. As shown in FIG. 7 to FIGS. 10(A), 10(B), a plurality of air vents 2501, three air vents 2501*a*, 2501*b*, 2501*c* in the present embodiment, for communication between the gap and the outside of the bracket 251, are provided in positions corresponding to the air vents 501*a*, 501*b*, 501*c* and are arranged in the peripheral direction. The air vents 2501*a*, 2501*b*, 2501*c* are drilled in positions closer to the center than the position of the ring-shaped fluid-stopper protrusion 2522.

As shown in FIG. 7 to FIGS. 10(A), 10(B), the fluid stopper protrusion 2522 is formed in a ring shape extending in a circle in the peripheral direction in a position closer to the outer periphery than the positions of the air vents 2501 in the gap formed between the bottom face of the speaker device 100 and the bracket 251, that is, in the recessed portion 2521. Also the fluid stopper protrusion 2522 protrudes from the bottom of the bracket 251 to the bottom face of the speaker device 100 in the direction of the sound radiation.

The ring-shaped fluid-stopper protrusion 2522 restrains the adhesive applied in between the speaker device 100 and the side portion of the bracket 251 from flowing into the air vents 2501 drilled through the bracket 251.

As shown in FIG. 7 to FIGS. 10(A), 10(B), the fluid basin 2523 is formed in a recess shape in a position closer to the outer periphery than the position of the fluid stopper protrusion 2522. The fluid basin 2523 restrains the adhesive applied in between the speaker device 100 and the side face of the bracket 251 from flowing into the air vents 2501 drilled through the bracket 251.

As shown in FIG. 7 to FIGS. 10(A), 10(B), the side portion 253 is formed in a shape bending from the outer peripheral end of the bottom of the bracket 251 in the direction of sound radiation (toward the front face). The side portion 253 is fixed to the speaker device 100 by partially or fully coating the inner face with an adhesive or the like.

The bracket 251 is not limited to the aforementioned form. For example, the frame 25 of the main speaker device 200 and the bracket 251 may be molded in one piece of a polymeric material such as a resin.

In the speaker unit 300 of the aforementioned structure, the main speaker device 200 and the tweeter speaker device 100 are coupled to each other through the bracket (mounting member) 251. In addition, the bracket 251 is formed in a recess shape and comprises the air vents 2501 interconnected to the air passage 85 of the tweeter speaker device 100 which is disposed in the bracket 251. Because of this, it is possible to surely dissipate heat from the inside of the speaker device 100.

In the bracket 251, a gap is formed between the bracket 251 and the bottom face of the speaker device 100 of the tweeter, and the air vents 2501 through which the gap and the outside of the bracket 251 (the outside of the mounting member) are connected to each other, are formed in positions corresponding to the air vents 501 which are formed in the frame 5 of the speaker device 100 of the tweeter. As a result, it is possible to surely dissipate heat from the inside of the speaker device 100.

Specifically, the bracket 251 comprises the ring-shaped fluid-stopper protrusion 2522 that extends in a circle in the peripheral direction in a position closer to the outer periphery than the positions of the air vents 2501 of the bracket 251 in the gap formed between the bottom face of the speaker device 100 of the tweeter and the bracket 251 and protrudes from the bottom of the mounting member to the bottom face of the speaker device 100 of the tweeter in the direction of the sound radiation. The fluid stopper protrusion 2522 surely restrains the adhesive applied in between the frame 5 of the speaker device 100 of the tweeter and the side portion of the bracket 251 from flowing into the air vents 2501 drilled through the bracket 251.

Third Embodiment

Figure 11:
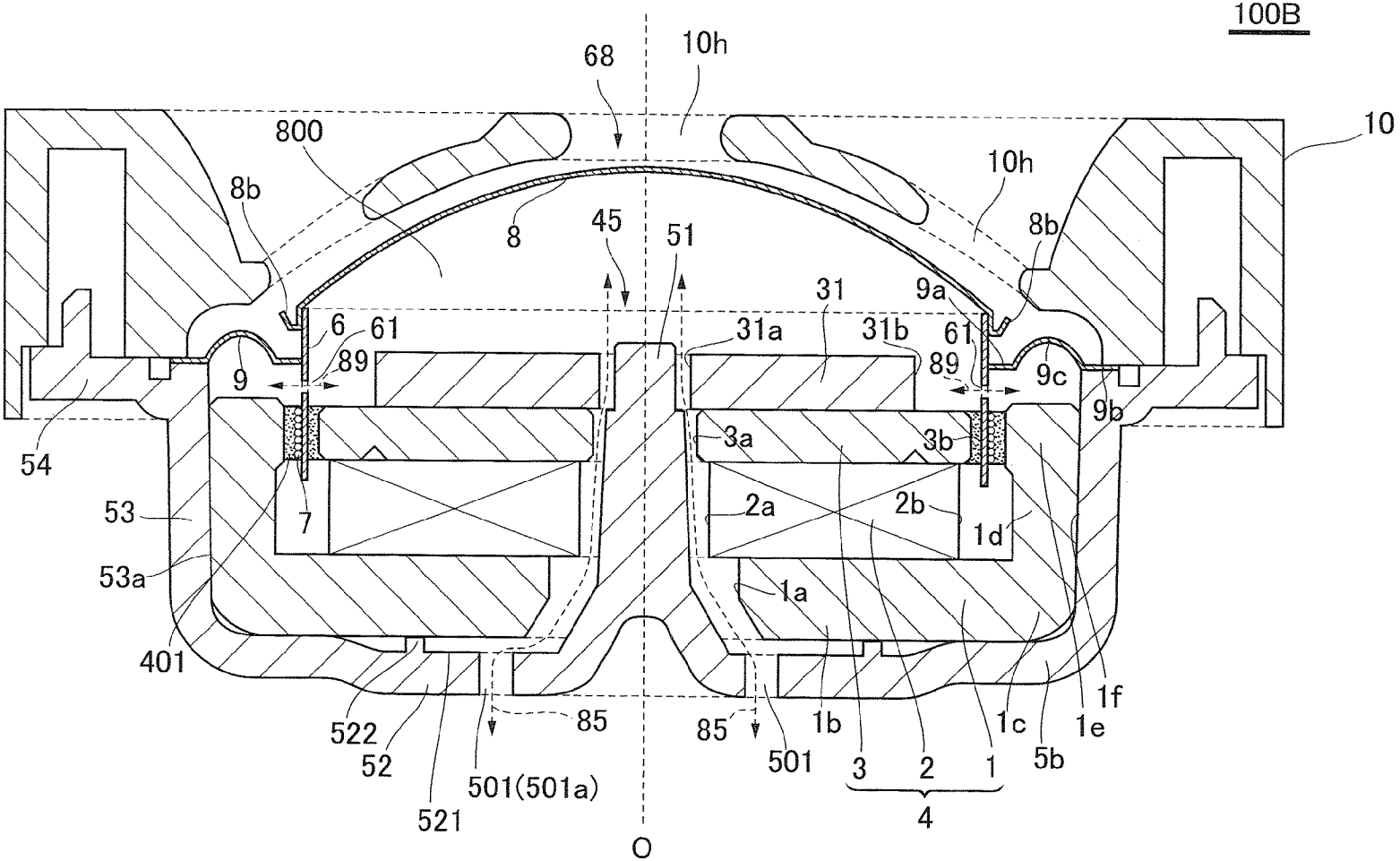
FIG. 11 is a sectional view of a speaker device 100B according to a third embodiment of the present invention.

FIG. 11 is a sectional view of a speaker device 100B according to a third embodiment of the present invention. A description is omitted of the structure and functions common to the speaker device 100B according to the present embodiment and the speaker device 100 according to the first embodiment.

In contrast to the speaker device 100 according to the first embodiment, the speaker device 100B according to the present embodiment is not provided with a mounting portion 55 on which an electron device such as a capacitor is mounted. Apart from this point, the speaker device 100B is similar in structure to the speaker device 100. That is, when the speaker device 100 is not used as a tweeter of the speaker unit 300, the mounting portion 55 may not be provided as in the speaker device 100B shown in FIG. 11.

Fourth Embodiment

Figure 12:
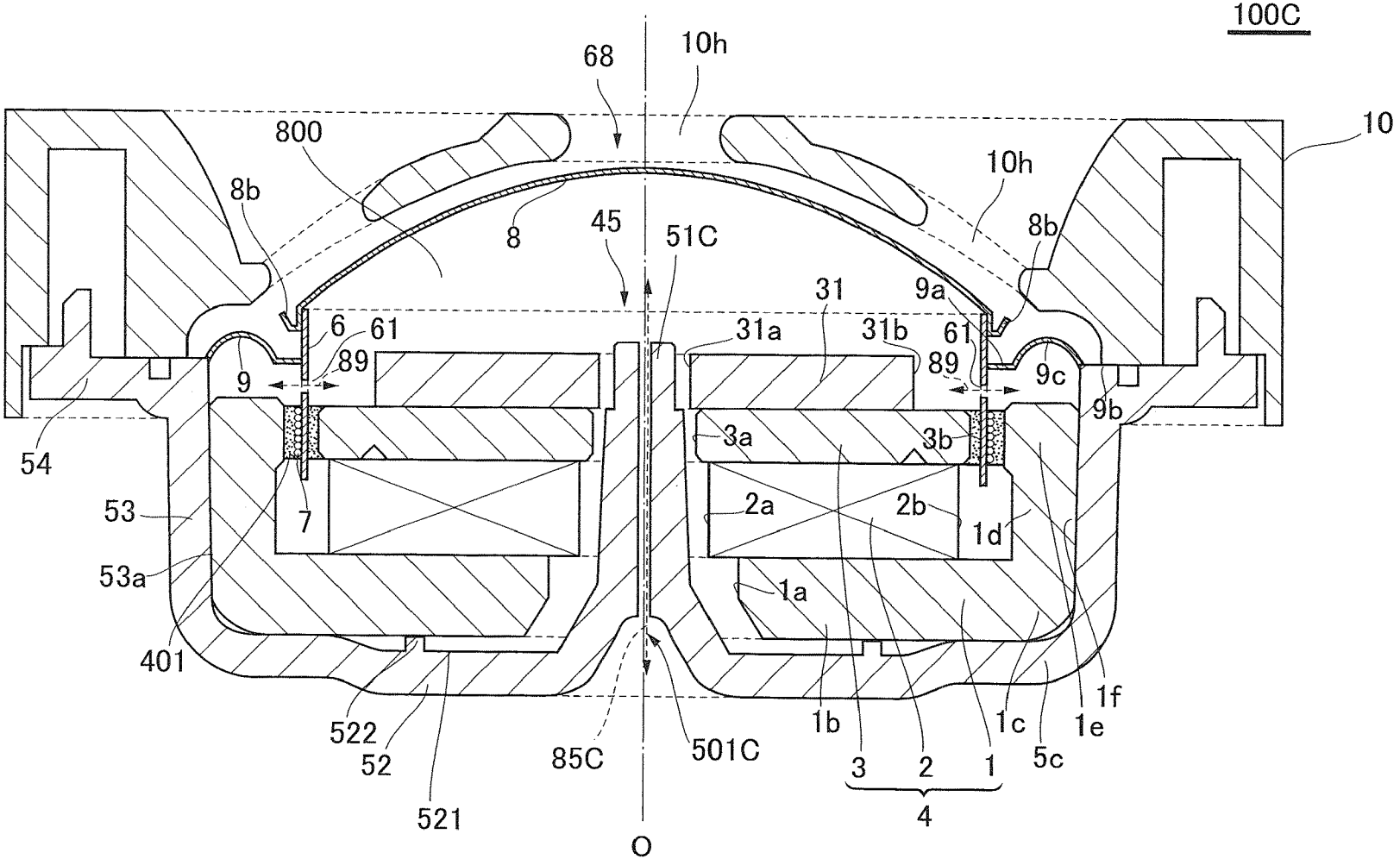
FIG. 12 is a sectional view of a speaker device 100C according to a fourth embodiment of the present invention.

FIG. 12 is a sectional view of a speaker device 100C according to a fourth embodiment of the present invention. A description is omitted of the structure and functions common to the speaker device 100C according to the present embodiment and the speaker device 100 according to the first embodiment.

In the speaker device 100C according to the present embodiment, a center boss (protrusion) 51C of the frame 5C has a through hole 501C extending therethrough in the longitudinal direction (center axis) and functioning as an air passage 85C.

In the speaker device 100C of the above structure, since the center boss 51C of the frame 5C has the through hole 501C extending therethrough in the longitudinal direction (center axis) and functioning as the air passage 85C, relatively effective dissipation of heat from the area inside the diaphragm 8 and the inside of the voice-coil bobbin 6 is possible.

Fifth Embodiment

Figure 13:
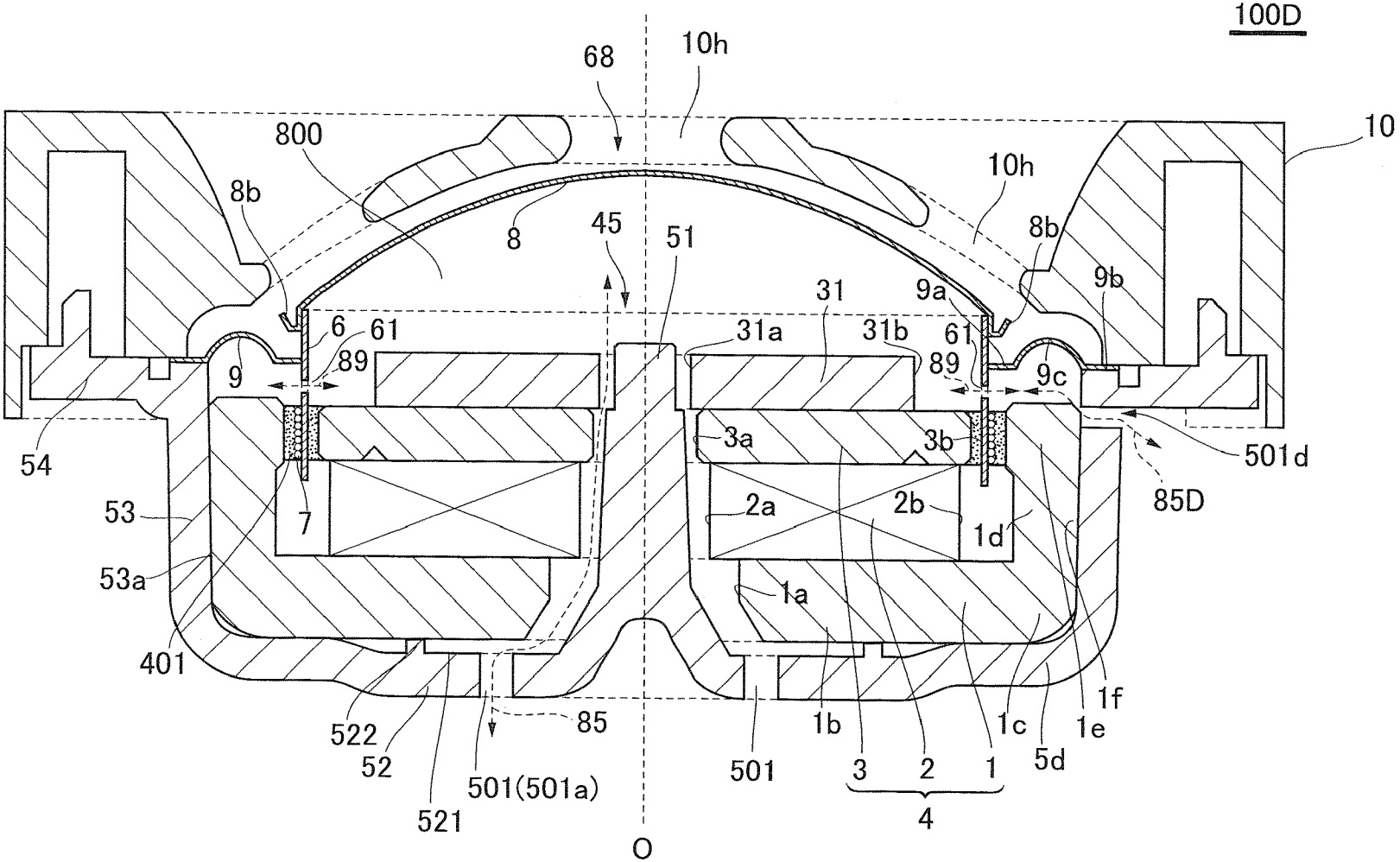
FIG. 13 is a sectional view of a speaker device 100D according to a fifth embodiment of the present invention.

FIG. 13 is a sectional view of a speaker device 100D according to a fifth embodiment of the present invention. A description is omitted of the structure and functions common to the speaker device 100D according to the present embodiment and the speaker device 100 according to the first embodiment.

In the speaker device 100D according to the present embodiment, an air vent 501*d* is drilled through the side portion of the frame 5*d* to provide communication between the area inside the edge 9 and the outside of the frame, so that an air passage 85D is formed to provide communication between the area inside the edge 9 and the outside of the frame. In addition, in the speaker device 100D, the voice-coil bobbin 6 has air vents 61 formed between the joint portion to the edge 9 and the portion on which the voice coil is wound, so that an air passage 89 providing communication between the area inside the edge 9 and the inside of the voice-coil bobbin 6.

In the speaker device 100D of the aforementioned structure, because communication between the inside of the voice-coil bobbin 6 and the outside of the frame is achieved by the air passage 89 and the air passage 85D, it is possible to more effectively dissipate heat from the area inside the diaphragm 8 and the inside of the voice-coil bobbin 6 as compared with the case of the first embodiment.

Sixth Embodiment

Figure 14:
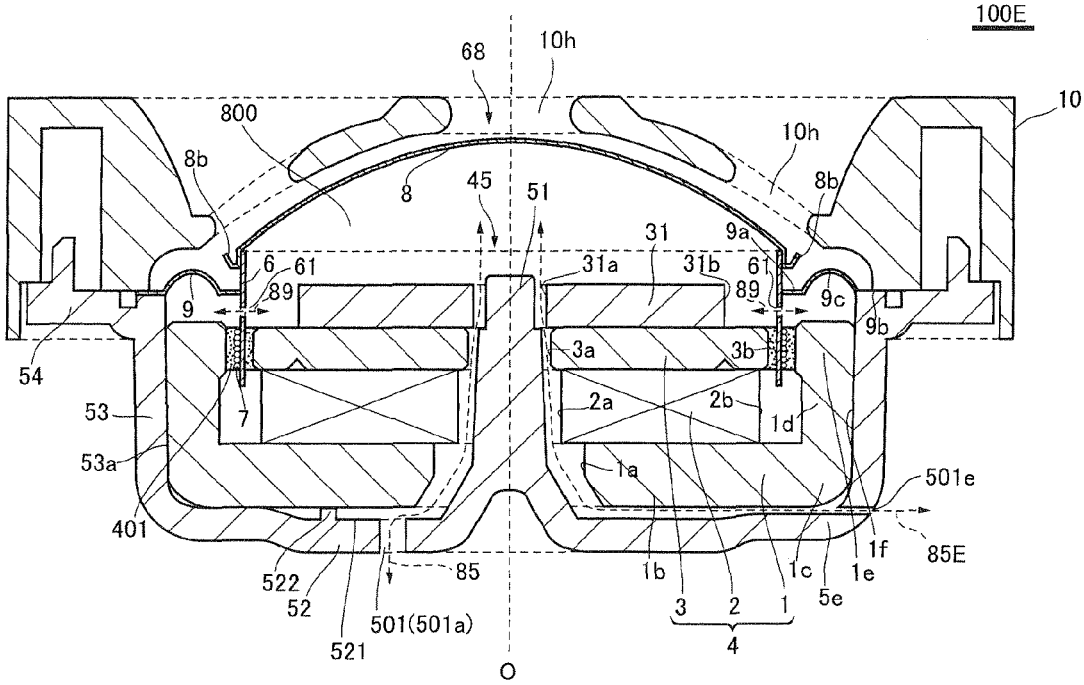
FIG. 14 consists of diagrams for illustrating a speaker device 100E according to a sixth embodiment of the present invention, specifically, FIG. 14(A) which is a sectional view for illustrating the speaker device 100E, and FIG. 14(B) which is a top view of a frame 5*e* of the speaker device 100E shown in FIG. 14(A) when viewed from the sound radiation side.
Figure 14:
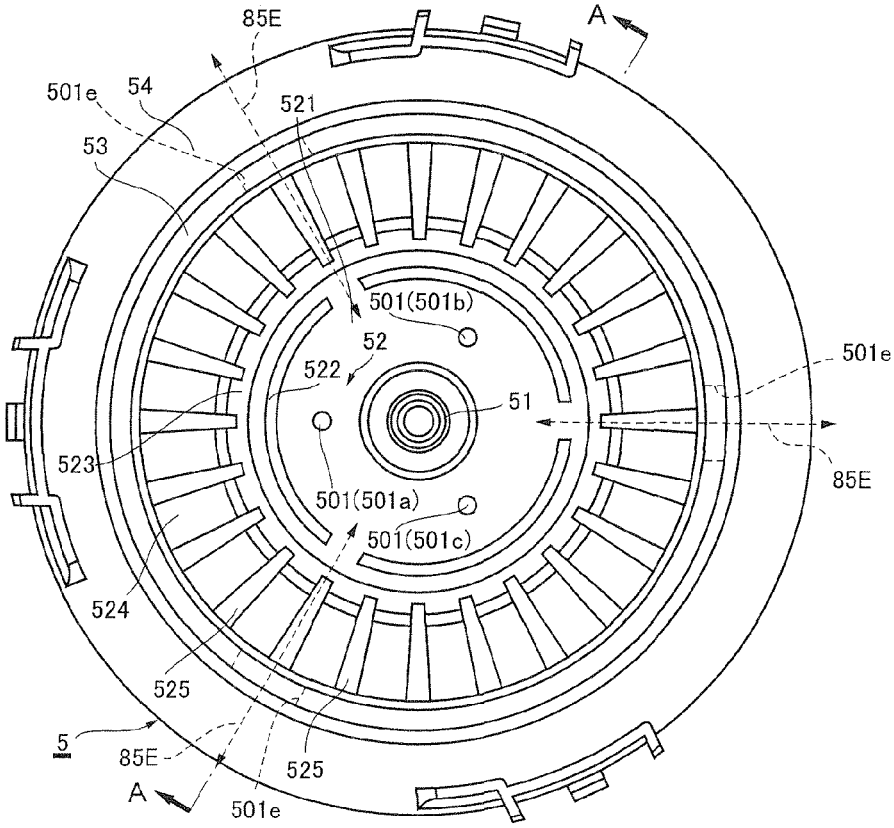

FIGS. 14(A), 14(B) are diagrams for illustrating a speaker device 100E according to a sixth embodiment of the present invention, specifically, FIG. 14(A) which is a sectional view for illustrating the speaker device 100E, and FIG. 14(B) which is a top view of a frame 5*e* of the speaker device 100E shown in FIG. 14(A) when viewed from the sound radiation side.

A description is omitted of the structure and functions common to the speaker device 100E according to the present embodiment and the speaker device 100 according to the first embodiment.

The speaker device 100E according to the present embodiment has air vents 501*e* drilled through the side portion of the frame 5*e* to communicate with the gap formed between the frame 5*e* and the bottom face of the yoke 1. The air vents 501*e* accordingly communicate with the inside of the voice-coil bobbin 6 to form the air passage 85. As shown in FIG. 14(B), the frame 5*e* according to the present embodiment has three air vents 501*e* formed in positions corresponding to the positions of air vents 501 (501*a*, 501*b*, 501*c*). In this connection, as shown in FIG. 14(B), for forming the air passage 85E, the approximately circle shaped fluid stopper protrusion 522 preferably has nicks cut in positions respectively corresponding to the positions of the air vents 501*e*.

In the speaker device 100E of the aforementioned structure, the air vents 501*e* are formed in the side portion of the frame 5*e* to communicate with the gap formed between the frame 5*e* and the bottom face of the yoke 1, so that the air vents 501*e* communicate with the inside of the voice-coil bobbin 6 to form the air passage 85. Specifically, the air passage 85 is formed below the bottom of the yoke 1. In consequence, it is possible to dissipate heat more effectively than the case of the first embodiment.

Seventh Embodiment

Figure 15:
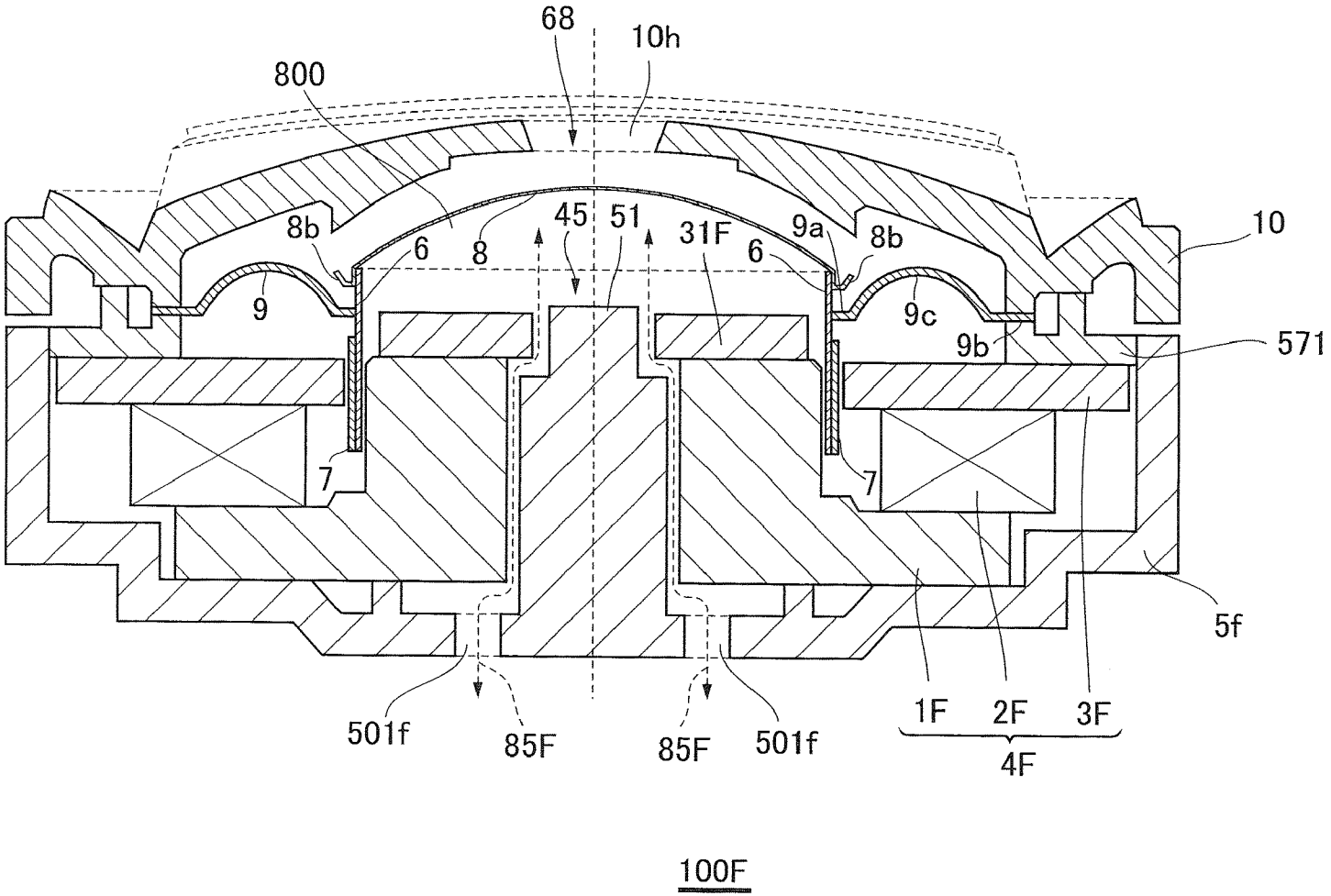
FIG. 15 is a sectional view of a speaker device 100F according to a seventh embodiment of the present invention.

FIG. 15 is a sectional view of a speaker device 100F according to a seventh embodiment of the present invention. A description is omitted of the structure and functions common to the speaker device 100F according to the present embodiment and the speaker device 100 according to the first embodiment.

As shown in FIG. 15, the speaker device 100F according to the present embodiment has an exterior-magnet-type magnetic circuit as a magnetic circuit 4F.

As shown in FIG. 15, the magnetic circuit 4F has a yoke 1F which is made up of a center pole having a through hole 45 formed in the approximate center portion and a bottom yoke spreading outward from the base end of the center pole in the radial direction and molded integrally with the center pole, a ring-shaped magnet 2F which is a permanent magnet and is provided coaxially with and around the center pole, and a plate 3F which is placed on the magnet 2F and is provided coaxially with and around the center pole. In the magnetic circuit 4F, the voice coil 7 wound on the voice-coil bobbin 6 is disposed in the magnetic gap.

The frame 5*f* is formed in a recess shape. The through hole 45 of the yoke 1F is fitted over the center boss (protrusion) 51 shaped to protrude from the bottom of the frame 5*f* toward the sound emission side. That is, the magnetic circuit 4F is positioned and fixed with respect to the frame 5*f*. Air vents 501*f* are drilled through the bottom of the frame 5*f*, to form an air passage 85F extending along the center boss 51 fitted in the through hole 45 of the magnetic circuit 4F for communication between the inside of the voice coil bobbin 6 and the outside of the frame.

A ring-shaped sound-absorbing material 31F is disposed on the center pole of the yoke 1F. The sound absorbing material 31F is positioned and fixed with respect to the yoke 1F by fitting the center boss 51 into the hole of the sound absorbing material 31F.

A ring-shaped member 571 is disposed on the plate 3F, and the outer periphery 9*b* of the edge 9 is secured on the ring-shaped member 571. In turn, the equalizer 10 is placed on the edge 9.

As described above, in the speaker device 100F of the aforementioned structure, the through hole 45 of the exterior-magnet-type magnetic circuit 4F is fitted over the center boss 51F of the frame 5*f*, so that the magnetic circuit 4F is positioned and fixed with respect to the frame 5*f* and the air passage 85F is formed along the center boss 51F. In consequence, the present invention is also applicable to an exterior-magnet-type magnetic circuit.

Eighth Embodiment

Figure 16:
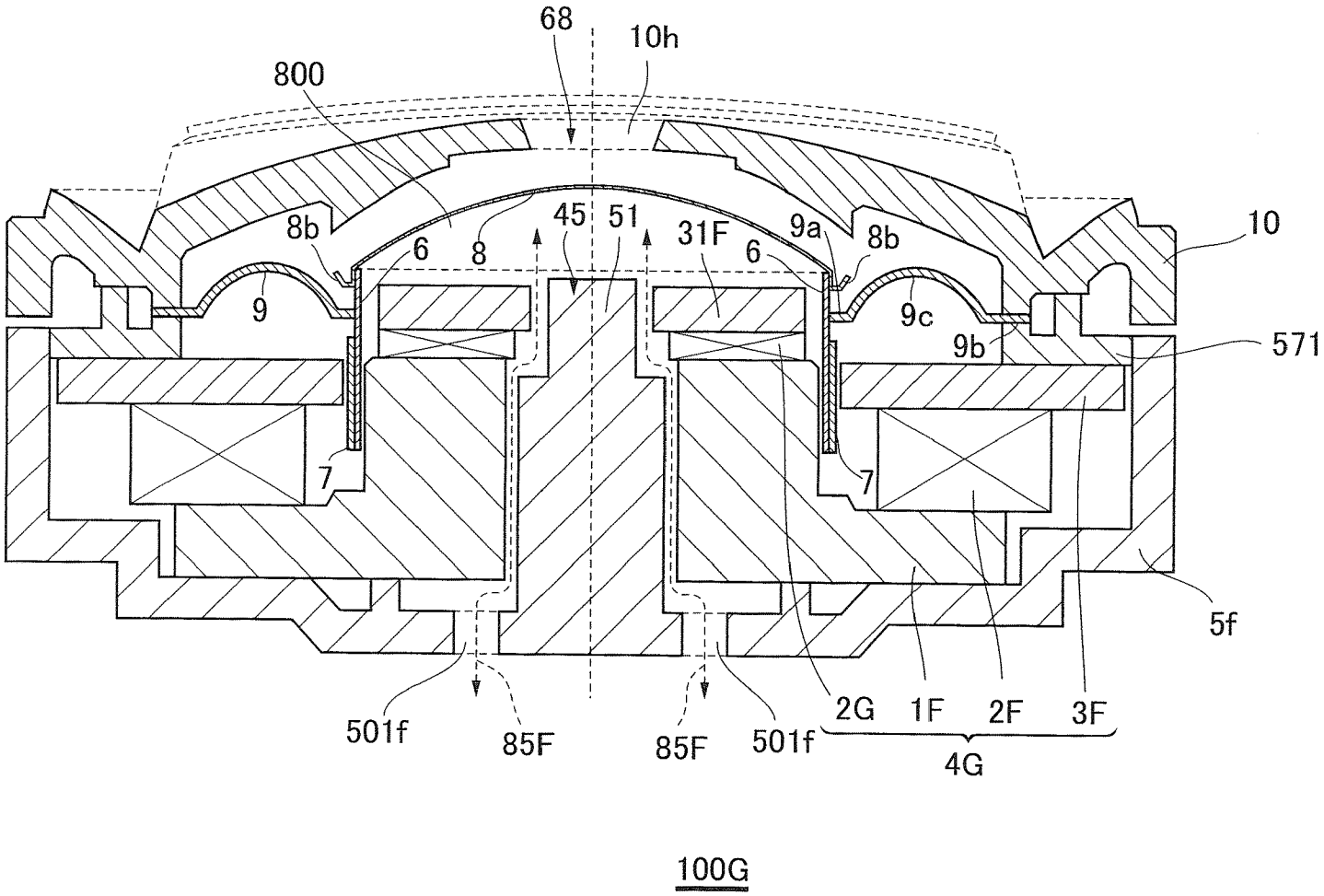
FIG. 16 is a sectional view of a speaker device 100G according to an eighth embodiment of the present invention.

FIG. 16 is a sectional view of a speaker device 100G according to an eighth embodiment of the present invention. A description is omitted of the structure and functions common to the speaker device 100G according to the eighth embodiment and the speaker device 100F according to the seventh embodiment.

As shown in FIG. 16, the magnetic circuit 4G of the speaker device 100G according to the present embodiment has a structure of a combination of an exterior-magnet-type magnetic circuit and an interior-magnet-type magnetic circuit. Specifically, the magnetic circuit 4G has a ring-shaped magnet 2G disposed between the yoke 1F and the sound absorbing material 31F placed on the center pole of the yoke 1F. The remaining structure is the same as that of the speaker device 100F according to the seventh embodiment.

Since the speaker device 100G of the aforementioned structure additionally comprises a ring-shaped magnet 2G, the magnetic flux density in the magnetic gap is higher than that of the magnetic circuit 4F according the seventh embodiment. In consequence, the reproduction of high quality sound is made possible.

Ninth Embodiment

Figure 17:
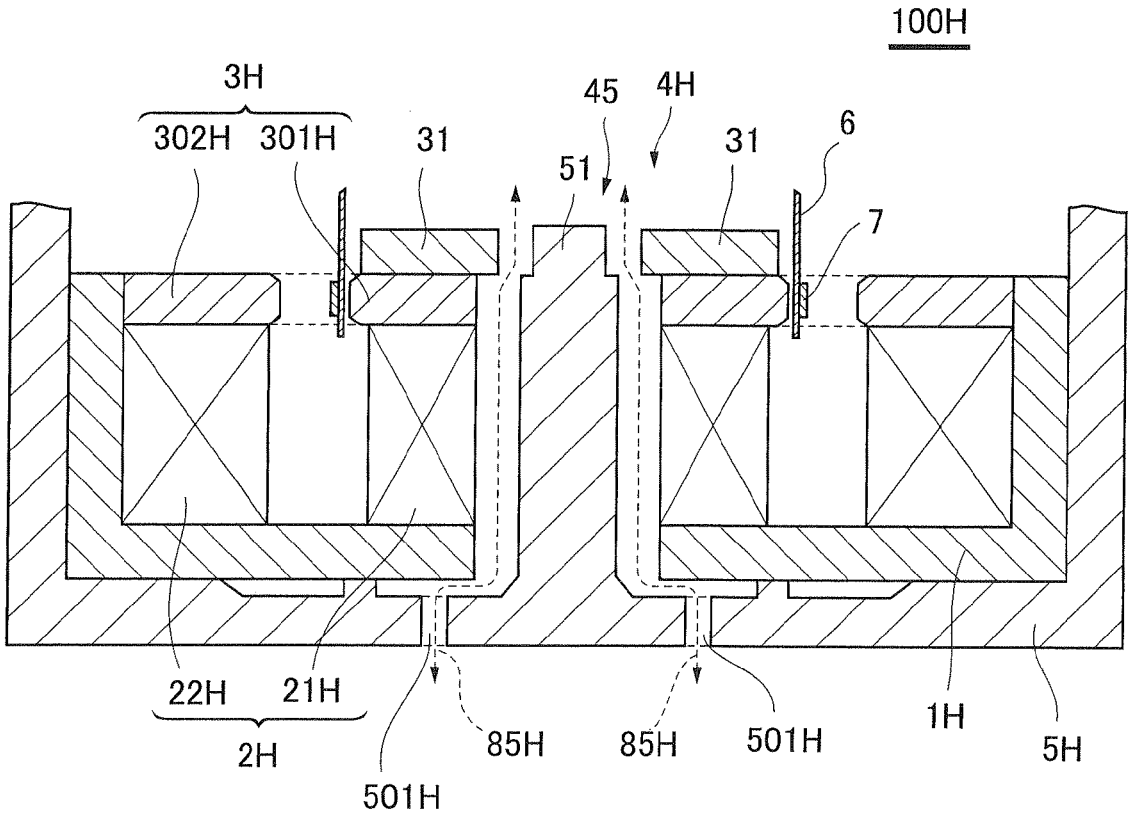
FIG. 17 is a sectional view of a speaker device 100H according to a ninth embodiment of the present invention, which is, specifically, an enlarged view an area around a magnetic circuit 4H.

FIG. 17 is a sectional view of a speaker device 100H according to a ninth embodiment of the present invention. Specifically, FIG. 17 is an enlarged view of a portion around a magnetic circuit 4H. A description is omitted of the structure and functions common to the speaker device 100H according to the present embodiment and the speaker devices according to other embodiments.

The magnetic circuit 4H of the speaker device 100H according to the present embodiment has a structure of a combination of an exterior-magnet-type magnetic circuit and an interior-magnet-type magnetic circuit, and comprises a magnet 2H which has a ring-shaped first magnet 21H disposed on a yoke 1H and a ring-shaped second magnet 22H placed coaxially with and on the outer-periphery side of the first magnet 21H, and a plate 3H which has a ring-shaped first plate 301H placed on the first magnet 21H and a ring-shaped second plate 302H placed on the second magnet 22H. The ring-shaped sound-absorbing material 31 is disposed on the first plate 301. On this first plate 301H, the ring-shaped sound-absorbing material 31 fitted over the center boss 51 is positioned and fixed.

In the speaker device 100H of the aforementioned structure, because the magnetic circuit 4H has the structure of a combination of an exterior-magnet-type magnetic circuit and an interior-magnetic-type magnetic circuit, the magnetic flux density in the magnetic gap is higher than that in the first embodiment, resulting in reproduction of high-quality sound. In addition, in the speaker device 100H, the center boss 51 protruding from the bottom of the frame 5H is fitted in the through hole 45, so that the magnetic circuit 4H is positioned and fixed with respect to the frame 5H and the air passage 85H is formed to be connected to the air vents 501H drilled through the bottom of the frame 5H. As a result, a great heat-dissipation effect is obtained.

The present invention is not limited to the aforementioned embodiments. The embodiments may be combined.

For example, in the aforementioned embodiments, the edge 9 is fixed to the voice-coil bobbin 6. However, the edge and the voice-coil bobbin are not limited to this form.

Figure 18:
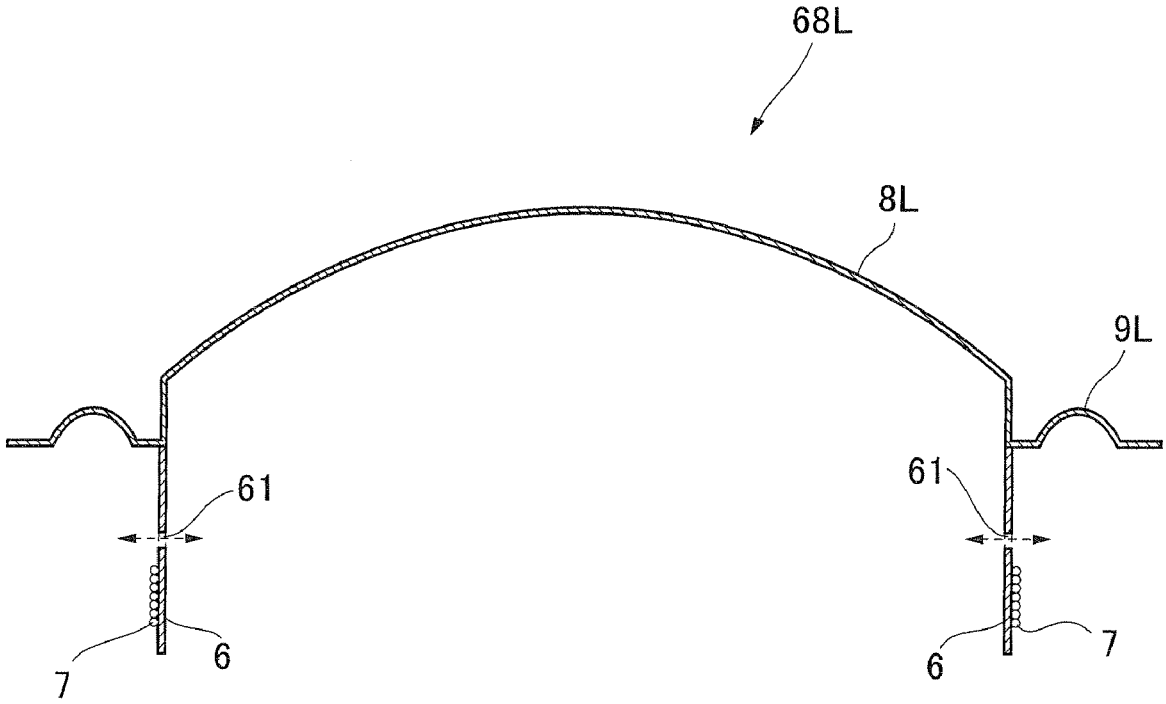
FIG. 18 is a sectional view for illustrating a vibration system member of a speaker device according to another embodiment of the present invention.

FIG. 18 is a sectional view illustrating a vibration system member 68L of a speaker device according to another embodiment of the present invention. For example, a vibration system member 68L comprising a diaphragm 8L coupled to the voice-coil bobbin 6 needs to be held through an edge 9L by the frame. Accordingly, the edge 9L may be coupled to the outer periphery of the diaphragm 8L. Alternatively, the diaphragm 8L and the edge 9L may be molded in one piece. Alternatively, the voice-coil bobbin 6 and the diaphragm 8 may be molded in one piece.

The diaphragm, edge, plate, magnet and the like which form the vibration system member may be shaped in, for example, a polygonal form such as a quadrangle. The outer shape of the frame may be also a polygonal shape.

As described above, the speaker device 100 according to the present invention has a recess-shaped frame 5 which supports through an edge 9 a vibration system member 68 comprising a diaphragm 8 coupled to a voice-coil bobbin 6, and a magnetic circuit 4 in which an approximately ring-shaped magnet 2 and an approximately ring-shaped plate 3 are mounted on a yoke 1 disposed in the frame 5 and a voice coil 7 wound on a voice-coil bobbin 6 is disposed in a magnetic gap 4*g*. In the magnetic circuit 4 a through hole 45 extending in the vibration direction of the diaphragm is fitted over a center boss 51 of a shape protruding from the bottom of the frame 5 in the direction of the sound emission, so that the magnetic circuit 4 is positioned and fixed with respect to the frame 5. An air passage 85 is formed along the center boss 51 fitted into the through hole 45 of the magnetic circuit 4 to establish air communication between the inside of the voice-coil bobbin 6 and the outside of the frame. In consequence, with simple structure, heat in the area inside the voice-coil bobbin and the diaphragm can be dissipated without a reduction in sound quality.

In the speaker device of the foregoing structure, for the positioning and fixing of the magnetic circuit 4 with respect to the frame 5, the through hole 45 of the magnetic circuit 4 is fitted over the center boss 51 of a shape protruding from the bottom of the frame 5 in the direction of the sound emission. Because of this, the assembling of the magnetic circuit 4 with respect to the frame with high accuracy can be achieved by a simple work.

Specifically, the magnetic circuit 4 is fitted, leaving a gap between the outer periphery of the center boss 51 of the frame 5 and the inner periphery of the through hole 45 of the magnetic circuit 4. The air passage 85 is achieved by communication between the gap extending along the center boss 51 and the air vents 501 formed through the frame 5. In consequence, with simple structure, the dissipation of heat from the area inside the voice-coil bobbin and inside the diaphragm can be achieved.

Regarding the frame 5, in turn, a gap is formed between the frame 5 and the bottom face of the yoke 1, and additionally, a plurality of air vents 501, which are provided for communication between this gap and the outside of the frame, are arranged along the peripheral direction and in positions at a predetermined distance from the center boss 51 in the radial direction, resulting in more efficient heat dissipation.

The frame 5 has a ring-shaped fluid-stopper protrusion 522 extending in a circle in the peripheral direction in a position closer to the outer periphery than the positions of the air vents 501 in the gap formed between the bottom face of the yoke 1 and the frame 5, and protruding from the bottom of the frame 5 to the bottom face of the yoke 1 in the direction of the sound radiation. For this reason, the ring-shaped fluid-stopper protrusion 522 is capable of restraining the adhesive applied in between the frame 5 and the side face of the yoke 1 from flowing into the air vents 501 drilled through the bottom of the frame 5.

Because the frame 5 further has a recess-shaped fluid basin 523 formed in a position closer to the outer periphery than the position of the approximately ring-shaped fluid-stopper protrusion 522 formed on the frame 5, the frame 5 is capable of restraining the adhesive applied in between the frame 5 and the side face of the yoke 1 from flowing into the air vents 501 drilled through the bottom of the frame 5.

The voice coil bobbin 6 is capable of adjusting the pressure in the area inside the edge 9, because air vents are formed between the joint portion to the edge 9 and the portion on which the voice coil is wound. By providing an air passage for communication between the area inside the edge 9 and the outside of the frame, it is possible to more efficiently dissipating heat.

The speaker device according to the present invention has a sound absorbing material 31 mounted on the plate 3 and having a hole formed therein. The hole of the sound absorbing material 31 is fitted over the center boss 51 which extends from the bottom of the frame 5, is then fitted into the through hole 45 of the magnetic circuit 4 and then extends above the plate 3, for the positioning and fixing of the sound absorbing material 31. Because of this, it is possible to readily position and fix the sound absorbing material 31 in place with high accuracy. Further, even when the sound absorbing material 31 is provided, the heat of air in the area inside the voice-coil bobbin 6 and inside the diaphragm 8 can be dissipated because the air passage 85 is provided.

The diaphragm 8 is formed of either a hard dome diaphragm or a soft dome diaphragm which is impervious to air. Even when the diaphragm 8 is coupled to the voice-coil bobbin 6 so as to cover the upper end of the voice-coil bobbin 6, the provision of the air passage 85 makes it possible to dissipate air heat from the area inside the voice-coil bobbin 6 and inside the diaphragm 8.

In a conventional speaker device having air vents formed, for example, in the diaphragm 8 or the edge, unwanted sound is produced from the air vents to reduce the sound quality. However, the speaker device 100 according to the present invention has the air vents formed in the back face or the side face of the frame 5. Accordingly, the speaker device 100 according to the present invention is capable of reproducing high quality sound without emission of such unwanted sound to the sound radiation side.

In addition, because in the magnetic circuit 4 the magnetic fluid 401 is interposed in the magnetic gap 4*g* in which the voice coil 7 is disposed, the speaker device 100 is capable of dissipating the heat from the voice coil 7 toward the plate 3, the yoke 1 and the like on passage of the audio electric current. The interposition of the magnetic fluid 401 in the magnetic gap 4*g* of the magnetic circuit 4 creates a substantially hermetically sealed space 800 inside the voice-coil bobbin 6 and inside the diaphragm 8. However, because the air vents 501 are formed through the back face of the frame 5 to form part of the air passage 85, the air heat in the area inside the voice-coil bobbin 6 and the diaphragm 8 can be dissipated.

As described earlier, the speaker device according to the present invention can employ, as a magnetic circuit, an interior-magnet-type magnetic circuit, an exterior-magnet-type magnetic circuit or a combination magnetic circuit of an interior magnet type and an exterior magnet type, so that the magnetic circuit is not limited to an interior-magnet-type magnetic circuit and an exterior-magnet-type magnetic circuit.

The speaker device 100 according to the present invention is applicable to a speaker unit 300 having a main speaker device 200 and a tweeter speaker device. In this case, the speaker unit 300 has a bracket (mounting member) 251 through which, for example, the main speaker device 200 and the tweeter speaker device 100 are coupled. The frame 251 is formed in a recess shape and has air vents 2501 connected to the air passage 85 of the tweeter speaker device 100 mounted in the bracket 251. As a result, even when the speaker device 100 is coupled to the main speaker device 200 through the bracket 251, the heat inside the speaker device 100 can be efficiently dissipated.

Preferably, a gap is formed between the bracket 251 and the bottom face of the tweeter speaker device 100, and air vents 2501 are provided in positions of the bracket 251 corresponding to the air vents 501 formed through the frame 5 of the tweeter speaker device 100, for communication between the gap and the out side of the bracket 251. In consequence, it is possible to efficiently dissipate heat from the inside of the speaker device 100.

In addition, a visual inspection of the air vents 501 through the air vents 2501 allows the easy checking whether or not the air vents 501 and the air vents 2501 are clogged with the adhesive.

The bracket 251 further has a ring-shaped fluid-stopper protrusion 2522 extending in a circle in the peripheral direction in a position closer to the outer periphery than the positions of the air vents 2501 of the bracket 251 in the gap formed between the bottom face of the tweeter speaker device 100 and the bracket 251, and protruding from the bottom of the bracket 251 to the bottom face of the tweeter speaker device 100 in the direction of the sound radiation. As a result, it is possible to restrain the adhesive applied in between the frame 5 of the tweeter speaker device 100 and the side portion of the bracket 251 from flowing into the air vents 2501 drilled through the bracket 251.

In short, the speaker device 100 according to the present invention is capable of stably reproducing sound without suffering deformation of the diaphragm 8.

Further, since the speaker device 100 according to the present invention is capable of preventing a rise in temperature of the voice coil 7, variations in resistance of the voice coil 7 can be prevented.

Further, since the speaker device 100 according to the present invention is capable of preventing variations in resistance of the voice coil, it is possible to supply a predetermined electric current to the voice coil 7 so as to stably drive the diaphragm 8, resulting in sound reproduction with high reliability.

Further, in the speaker device 100 according to the present invention, because the vent passage 85 is provided, even if expansion and contraction of the air in the space 800 enclosed by the diaphragm 8, frame 5, yoke 1, plate 3 and the magnetic fluid 401 occur, the temperature can be prevented from rising to become relatively high.

Further, in the speaker device 100 according to the present invention, because the vent passage 85 is provided, even if expansion and contraction of the air in the enclosed space 800 occur, the amount of change in air volume can be reduced. For this reason, it is possible to prevent the diaphragm 8 from being deformed by stress caused by the expansion and contraction.

Further, in the speaker device 100 according to the present invention, when a polymeric material such as a resin is employed as materials for forming the frame 5, heat is not easily dissipated from the yoke 1 and the like in terms of structure. However, because the air passage 85 is provided, a rise in temperature can be prevented. In addition, deformation of the diaphragm 8 can be reduced. Further, variations in resistance of the voice coil 7 can be reduced.

The invention claimed is:

1. A speaker device, comprising:

a recess-shaped frame supporting, through an edge, a vibration system member provided with a diaphragm coupled to a voice-coil bobbin; and a magnetic circuit including an approximately ring-shaped magnet and an approximately ring-shaped plate which are mounted on a yoke disposed in said frame, and a magnetic gap in which a voice coil wound on said voice-coil bobbin is disposed, wherein said magnetic circuit has a through hole, which extends in a vibration direction of said diaphragm, said frame has a protrusion of a shape protruding from a bottom of said frame in a direction of sound emission through an inside of said through hole, and an air passage is formed between said protrusion and said magnetic circuit; and wherein an outer diameter of said air passage is formed to gradually decrease in size from the bottom of said frame in the direction of said sound emission.

2. The speaker device according to claim 1, wherein:

said magnetic circuit is fitted, leaving a gap between an outer periphery of the protrusion of said frame and an inner periphery of the through hole of said magnetic circuit; and said air passage is provided by communication between said gap extending along said protrusion and an air vent formed in said frame.

3. The speaker device according to claim 2, wherein said frame has a gap formed between the frame and a bottom face of said yoke, and said air vent for communication between the gap formed between the frame and a bottom face of said yoke and the outside of the frame, are arranged in plural along a peripheral direction and in positions at a predetermined distance from said protrusion in a radial direction.

4. The speaker device according to claim 3, wherein:

said frame has a ring-shaped protrusion extending in a circle in the peripheral direction in a position closer to the outer periphery than a position of said air vent in the gap formed between the bottom face of said yoke and the frame, and protruding from the bottom of the frame to the bottom face of said yoke in the direction of said sound emission; and the ring-shaped protrusion restrains an adhesive applied in between said frame and a side face of said yoke from flowing into said air vent drilled through the bottom of said frame.

5. The speaker device according to claim 4, wherein said frame has a recess-shaped fluid basin formed in a position closer to the outer periphery than a position of the approximately ring-shaped protrusion formed on the frame, and restraining the adhesive applied in between said frame and the side face of said yoke from flowing into said air vent drilled through the bottom of said frame.

6. The speaker device according to claim 1, wherein the protrusion of said frame has a through hole extending in the protrusion in a longitudinal direction and has a function as said air passage.

7. The speaker device according to claim 1, wherein said frame is equipped with an air vent drilled through a side portion of the frame and communicating with a gap formed between said frame and the bottom face of said yoke.

8. The speaker device according to claim 1, wherein said voice-coil bobbin has an air vent formed between a joint portion to said edge and a portion on which the voice coil is wound.

9. The speaker device according to claim 8, wherein said frame has an air vent provided for communication between an area inside said edge and the outside of the frame.

10. The speaker device according to claim 1, further comprising a sound absorbing material placed on said plate and having a hole formed therein, wherein said sound absorbing material is positioned and fixed by fixing said hole over said protrusion which extends from the bottom of said frame, is then fitted into the through hole of said magnetic circuit, and then extends above said plate.

11. The speaker device according to claim 1, wherein said diaphragm is formed of either a hard dome diaphragm or a soft dome diaphragm which is impervious to air, and is coupled to said voice-coil bobbin to cover an upper end of the voice-coil bobbin.

12. The speaker device according to claim 1, wherein said magnetic circuit has a magnetic fluid interposed in the magnetic gap in which said voice coil is disposed.

13. The speaker device according to claim 1, wherein said magnetic circuit is formed of an interior-magnet-type magnetic circuit, an exterior-magnet-type magnetic circuit or a combination magnetic circuit of an interior magnet type and an exterior magnet type.

14. The speaker device according to claim 1, wherein:

said magnetic circuit is an interior-magnet-type magnetic circuit;

said ring-shaped magnet is placed on said yoke having said through hole formed therethrough and then said ring-shaped plate is placed on the magnet; and the through holes respectively formed through said yoke, said magnet and said plate are formed concentrically with each other.

15. The speaker device according to claim 1, wherein said magnetic circuit comprises a ring-shaped first magnet disposed on said yoke, a ring-shaped second magnet placed concentrically with and on an outer-periphery side of the first magnet, a ring-shaped first plate placed on the first magnet and a ring-shaped second plate placed on the second magnet.

16. The speaker device according to claim 1, wherein said magnetic circuit comprises a ring-shaped first magnet disposed on said yoke, a ring-shaped second magnet placed concentrically with and on an outer-periphery side of the first magnet and a ring-shaped first plate placed on the first magnet, and an end of the yoke is formed in a shape extending on said second magnet.

17. The speaker device according to claim 1, wherein:

an outer diameter of said air passage between said protrusion and said yoke is larger than an outer diameter of said air passage between said protrusion and said magnet; and the outer diameter of said air passage between said protrusion and said magnet is larger than an outer diameter of said air passage between said protrusion and said plate.

18. The speaker device according to claim 1, wherein an inner diameter of said yoke is larger than an inner diameter of said approximately ring-shaped magnet; and the inner diameter of said approximately ring-shaped magnet is larger than an inner diameter of said approximately ring-shaped plate.

19. The speaker device according to claim 1, wherein:

said magnetic circuit is positioned and fixed with respect to said frame by fitting said through hole, which extends in the vibration direction of said diaphragm, over said protrusion of the shape protruding from the bottom of said frame in the direction of said sound emission.

20. A speaker unit comprising a main speaker device and a tweeter speaker device, wherein said tweeter speaker device comprises:

a recess-shaped frame supporting, through an edge, a vibration system member provided with a diaphragm coupled to a voice-coil bobbin; and a magnetic circuit including an approximately ring-shaped magnet and an approximately ring-shaped plate which are mounted on a yoke disposed in said frame, and a magnetic gap in which a voice coil wound on said voice-coil bobbin is disposed, wherein said magnetic circuit has a through hole, which extends in a vibration direction of said diaphragm, said frame has a protrusion of a shape protruding from a bottom of said frame in a direction of sound emission through an inside of said through hole, and an air passage is formed between said protrusion and said magnetic circuit; and wherein an outer diameter of said air passage is formed to gradually decrease in size from the bottom of said frame in the direction of said sound emission.

21. The speaker unit according to claim 20, further comprising a mounting member for coupling said main speaker device and said tweeter speaker device to each other, wherein said mounting member is formed in a recess shape, and has an air vent communicating with said air passage of said tweeter speaker device mounted in the mounting member.

22. The speaker unit according to claim 21, wherein said mounting member has a gap formed between a bottom face of said tweeter speaker device and the mounting member, wherein said air vent providing communication between the gap and an outside of the mounting member are formed in positions corresponding to the air vent formed through the frame of said tweeter speaker device.

23. The speaker unit according to claim 22, wherein said mounting member has a ring-shaped protrusion extending in a circle in a peripheral direction in a position closer to an outer periphery than the positions of the air vent of said mounting member in the gap formed between the bottom face of said tweeter speaker device and the mounting member, and protruding from a bottom of the mounting member to the bottom face of said tweeter speaker device in the direction of the sound emission; and the ring-shaped protrusion restrains an adhesive applied in between the frame of said tweeter speaker device and a side portion of the mounting member from flowing into the air vent of said mounting member.

* * * * *